US007557776B2

(12) United States Patent
Inoue et al.

(10) Patent No.: US 7,557,776 B2
(45) Date of Patent: Jul. 7, 2009

(54) PLASMA DISPLAY APPARATUS

(75) Inventors: Hirokazu Inoue, Tokai (JP); Yukio Akiyama, Yokohama (JP); Kiyoshi Watanuki, Yokohama (JP); Michitaka Ohsawa, Fujisawa (JP)

(73) Assignees: Hitachi, Ltd., Tokyo (JP); Advanced PDP Development Center Corporation, Tokyo (JP)

( * ) Notice: Subject to any disclaimer, the term of this patent is extended or adjusted under 35 U.S.C. 154(b) by 594 days.

(21) Appl. No.: 11/113,175

(22) Filed: Apr. 25, 2005

(65) Prior Publication Data

US 2005/0237275 A1 Oct. 27, 2005

(30) Foreign Application Priority Data

| | | |
|---|---|---|
| Apr. 26, 2004 | (JP) | 2004-129149 |
| Apr. 26, 2004 | (JP) | 2004-129151 |
| May 18, 2004 | (JP) | 2004-147122 |
| Dec. 20, 2004 | (JP) | 2004-366990 |

(51) Int. Cl.
*G09G 3/28* (2006.01)

(52) U.S. Cl. ..... 345/60; 361/719

(58) Field of Classification Search ..... 345/60; 349/150; 315/169.4; 439/66; 361/719, 720, 361/718; 313/600; 445/24
See application file for complete search history.

(56) References Cited

U.S. PATENT DOCUMENTS 6,144,349 A * 11/2000 Awata et al. ..... 345/67

FOREIGN PATENT DOCUMENTS

| | | |
|---|---|---|
| EP | 1 508 891 A1 | 2/2005 |
| JP | 10-282896 | 10/1998 |
| JP | 2002-150943 | 5/2002 |

* cited by examiner

*Primary Examiner*—Abbas I Abdulselam
(74) *Attorney, Agent, or Firm*—Antonelli, Terry, Stout & Kraus, LLP.

(57) ABSTRACT

For a drive circuit of a sustaining discharge circuit of an AC plasma display panel, an idea of current flow parts arrangement is provided to reduce inductance. The configuration includes a plasma display panel on which electrodes are formed, an electric conductive conductor for fixing the panel, a pair of circuit boards fixed onto the conductor using a plurality of fixing members, ground terminals and electric power supplies disposed respectively for the circuit boards, and a pair of connecting circuit boards connected to end portions respectively of the circuit boards and an end portion of the panel. The ground terminals are electrically connected via fixing members to a position near an end portion of the conductor.

23 Claims, 17 Drawing Sheets

PLASMA DISPLAY APPARATUS

BACKGROUND OF THE INVENTION

The present invention relates to a plasma display apparatus using a plasma display panel.

A display device (to be referred to as a plasma display apparatus hereinbelow) using a plasma display panel is small in depth as a feature of the general flat panel display and additionally has a free viewing angle, which helps implement a large screen. Therefore, the plasma display apparatus is regarded as a most likely candidate for large screen flat panel televisions.

However, unlike a display device using a liquid crystal display panel which is also a flat panel display, the plasma display panel has drawbacks that electric discharge is used to display pictures and hence requires large power consumption and radiated interference is strong because the panel has a large area. JP-A-10-282896 describes a technique to suppress radiated interference occurring in a display device.

Radiated interference is caused by, for example, occurrence of an undesired voltage in association with a current change. In the plasma display apparatus, the current used to display pictures is supplied in the form of pulse signals. The current change is quite frequent, which hence leads to the problem of the undesired voltage. Occurrence of the undesired voltage makes a voltage applied to the panel unstable and resultantly deteriorates picture, quality. This exerts direct influence upon quality of pictures displayed on the panel. Consequently, suppressing the undesired voltage to a maximum extent is effective to improve overall performance of the plasma display panel. To suppress the undesired voltage, it is required to minimize an inductive portion and inductance of the associated circuit of the plasma display panel.

To reduce inductance, it is generally effective to reduce the wiring length and to increase the wiring width. When such a measure is not feasible or when an additional measure is required, an eddy current may possibly be used. JP-A-2002-150943 describes a technique to reduce inductance in a plasma display device.

Although it is required to reduce an inductive portion in almost all sections of the circuit, an advantage is remarkably obtained by reducing the inductive portion in a path of a large current. In a plasma display panel, the largest current flows in a sustaining discharge circuit. Specifically, a sustaining discharge current, i.e., a current to display an image through electric discharge flows through the sustaining discharge circuit. This circuit is used to emit light in the panel. In the overall plasma display panel, currents of pulse signals having a current value exceeding 100 ampere (A) flow through the circuit at same timing.

The sustaining discharge circuit has a length almost equal to a lateral width of the plasma display panel and forms a long loop and hence has high inductance. According to study of distribution of inductance in the circuit, it is known that large inductance appears in a pair of printed circuit boards and ground level wiring connecting the circuit boards to each other, excepting the main section of the panel. It is desired to reduce inductance in these sections for the following reason. Since a large current flows through and a high voltage is applied to the panel, adverse influences occur due to a voltage drop, waveform disturbance, and/or occurrence of electromagnetic interference during the electric discharge.

However, none of the above patent articles has given consideration to a configuration to reduce inductance by reducing the inductive portion of the wiring in the printed circuit boards in which a sustaining discharge circuit is arranged.

SUMMARY OF THE INVENTION

It is therefore an object of the present invention to provide a plasma display apparatus having high picture quality capable of reducing inductance in printed circuit boards including a sustaining discharge circuit.

To achieve the object in accordance with the present invention, there is provided a plasma display apparatus including a plasma display panel on which electrodes are formed, an electric conductive conductor for fixing the plasma display panel, a pair of circuit boards including a first circuit board and a second circuit board fixed onto the conductor using a plurality of fixing members, electric power supplies disposed respectively for the first and second circuit boards, and a pair of connecting circuit boards connected to end portions respectively of the first and second circuit boards and an end portion of the plasma display panel. In the first circuit board, a direction of current supplied from the first circuit board to one of the pair of connecting circuit boards is substantially equal to a direction of a current supplied from the conductor to the first circuit board.

According to the present invention, there is provided a plasma display apparatus including a plasma display panel on which electrodes are formed, an electric conductive conductor for fixing the plasma display panel, a pair of circuit boards including a first circuit board and a second circuit board fixed onto the conductor using a plurality of fixing members, ground terminals and electric power supplies disposed respectively for the first and second circuit boards, and a pair of connecting circuit boards connected to end portions respectively of the first and second circuit boards and an end portion of the plasma display panel. The ground terminals respectively of the first and second circuit boards are electrically connected via the fixing members to positions in the vicinity of an end portion of the conductor.

In the plasma display apparatus, the current supplied from the first circuit board flows through one of the pair of connecting circuit boards, the plasma display, other one of the pair of connecting circuit boards, and the second circuit board in this order. The current further flows through the fixing members connected to the second circuit board, the conductor, the fixing members connected to the first circuit board, and the first circuit board.

In the plasma display apparatus, a direction of a current flowing in the plasma display panel is opposite to a direction of a current flowing in the conductor.

The plasma display apparatus further includes a pair of electric conductive plates disposed between the conductor and the first and second circuit boards. Currents supplied respectively from the first and second circuit boards flow respectively via the associated electric conductive plates to the conductor.

According to the present invention, there is provided a plasma display apparatus including a plasma display panel on which electrodes are formed, an electric conductive conductor for fixing the plasma display panel, a pair of circuit boards including a first circuit board and a second circuit board connected via a pair of connecting circuit boards to a side surface of the plasma display panel, electric power supplies disposed respectively for the first and second circuit boards, and a pair of electric conductive plates disposed on a side of the first and second circuit boards opposing to a side on which the plasma display panel is disposed. The plates are electrically connected via the first and second circuit boards and fixing members to the conductor.

According to the present invention, there is provided a plasma display apparatus including a plasma display panel on which electrodes are formed, an electric conductive conductor for fixing the plasma display panel, the conductor having a gap, a pair of circuit boards including a first circuit board and a second circuit board fixed via respective fixing members on a surface of the conductor opposing a surface on which the plasma display panel is disposed, the first and second circuit boards being electrically connected to the conductor and a pair of connecting circuit boards including first and second connecting circuit boards for electrically connecting the first and second circuit boards to a side surface of the plasma display panel.

According to the present invention, there is provided a plasma display apparatus including a plasma display panel on which electrodes are formed, an electric conductive conductor for fixing the plasma display panel, two electric conductive plates including first and second electric conductive plates disposed on a surface of the conductor opposing a surface on which the plasma display panel is disposed, the electric conductive plates being electrically connected to an end portion of the conductor; two circuit boards including a first circuit board and a second circuit board electrically connected respectively to the electric conductive plates, the first and second circuit boards being separately disposed in association with the plates; and a connecting circuit board connected to the first and second circuit boards and the plasma display panel. The plates are disposed respectively in parallel to two orthogonal edges of the conductor, the orthogonal edges intersecting each other at a right angle.

As a result, there can be provided a plasma display apparatus which reduces inductance in printed circuit boards including a sustaining discharge circuit to show uniform, stable and high fidelity pictures.

DESCRIPTION OF THE EMBODIMENTS

Description will now be given in detail of embodiments of the present invention. The embodiments can be appropriately changed or modified in various ways according to technical ideas described in the present specification, and the present invention is not restricted by the embodiments.

First Embodiment

Referring to FIGS. 1, 2, 3A, 3B, and 3C, description will be given of a first embodiment of the present invention.

Figure 1:
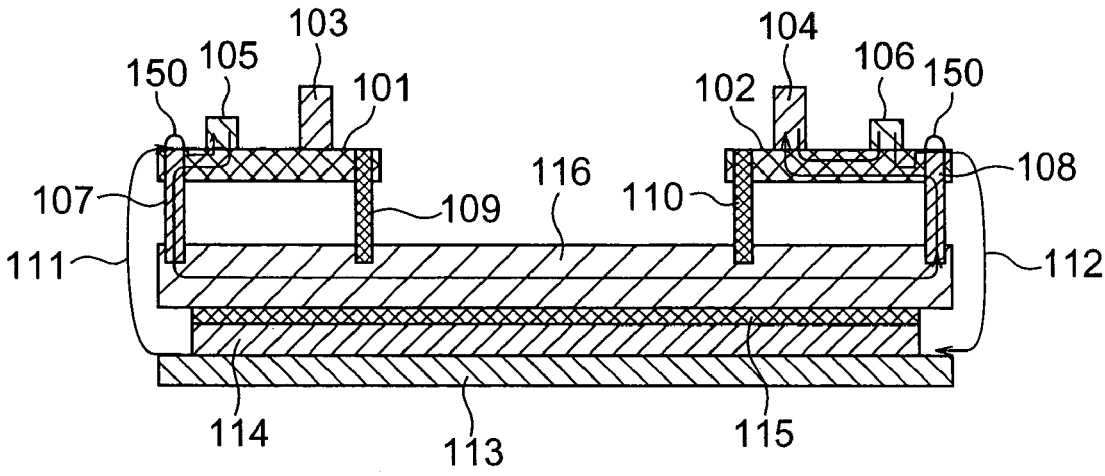
FIG. 1 is a cross-sectional view showing a cross section of a first embodiment of a plasma display apparatus according to the present invention.

FIG. 1 shows a cross section of a plasma display apparatus in the first embodiment of the present invention taken along a longitudinal direction (horizontal direction).

A plasma display panel includes two plates of glass. In FIG. 1, the lower end is a front surface of the panel, namely, a front panel 113 (a first panel). On a rear side of the panel 113 (on an upper side in FIG. 1), a rear panel 114 (second panel) is disposed. In a space sandwiched by the front and rear panels, plasma discharge is caused to display an image. On the front panel 113, an X-electrode and a Y-electrode, not shown, are formed for the display operation. On a rear side (an upper side in FIG. 1) of both panels, there is arranged an aluminum chassis 116 (1.5 mm thick) which is an electrically conductive conductor to fix the plasma display panel. The overall complete product of the plasma display including the plasma display panel and an outer case, not shown, is fixedly attached onto the chassis 116 using a double-stick tape 115.

Onto the aluminum chassis 116, a pair of circuit boards, i.e., a Y-side sustaining discharge circuit board 101 and an X-side sustaining discharge circuit board 102 are fixed using a plurality of fixing members. These circuit boards 101 and 102 are used to conduct sustaining discharge, that is, discharge for display. Through these circuit boards, a most large current (sustaining discharge current) flows in the plasma display panel. It is therefore required to reduce inductance of these circuit boards.

The power source or supply of the sustaining discharge is a pair of current sources including a Y-side power supply capacitor 103 and an X-side power supply capacitor 104. The plasma display apparatus according to the present invention is driven by an alternating current (AC). That is, the capacitors 103 and 104 alternately serve as a power source.

Description will now be given of a path of the sustaining discharge current along the current path. In the description, the apparatus operates in a phase in which one of the current supplies, i.e., the X-side power supply capacitor 104 is supplying a current. A current from a high side terminal of the capacitor 104 flows through a route to the panel according to an X-side semiconductor switch 106 which is a semiconductor switch to control the current supplied thereto. That is, the current passes through one of the circuit boards, i.e., the X-side sustaining discharge circuit board 102 and is fed to an X-side flexible printed circuit board 112 which is a connecting circuit board to connect an end portion of the circuit board 102 to an end portion of the plasma display panel. At this point, the current changes from a concentrated (narrow path) flow into a dispersed (broad path) flow. The sustaining discharge current having conducted discharge in the space interposed between the front panel 113 and the rear panel 114 flows into the Y-side sustaining discharge printed circuit board 101 through a Y-side flexible printed circuit board 111 which is a connecting circuit board to connect an end portion of the circuit board 101 to a terminal of the plasma display panel. At this point, the current changes to a concentrated flow. The current is introduced by an X-side semiconductor switch 105 including a semiconductor switch to ground level wiring of the printed circuit board of the circuit board 101. The current is fed from a ground terminal 150 disposed in the ground level wiring to the aluminum chassis 116 via an Y-side electric connecting boss 107 as a fixing member. At this point, the current changes to a dispersed flow. The sustaining discharge current having passed through the chassis 116 in almost a parallel way changes to a concentrated flow when the current enters an X-side electric connecting boss 108. The current flows through ground level wiring of the printed circuit of the circuit board 102 into a ground terminal, not shown, of the X-side power supply capacitor 104 of the semiconductor switch, thereby completely forming a loop.

Description has been given of the embodiment using the diagrams in which a pair of printed circuit boards such as the X-side and Y-side sustaining discharge printed circuit boards are disposed. However, when the embodiment using only one printed circuit board including a pair of sustaining discharge drive circuits, the sustaining discharge current flows through a path similar to that described above.

The embodiment has aspects as below. For the fixing members to support the Y-side sustaining discharge printed circuit board 101, a central-side supporting member on the aluminum chassis 116, i.e., a Y-side electric cut-off boss 109 is used for electric insulation. Similarly, for the supporting members to support the X-side sustaining discharge printed circuit board 102, a central-side supporting member on the chassis 116, i.e., an X-side electric cut-off boss 110 is used for electric insulation. As a result, the current is forcibly fed from the fixing members disposed at end portions of the printed circuit board to positions near end portions of the chassis 116 as an electric conductor. In addition, the current flowing between the printed circuit board and the connecting circuit board connected to an end portion of the plasma display panel and the current flowing between the aluminum chassis and the inside of the printed circuit board occur beginning at a position on one side of each of the printed circuit boards 101, 102 connected to each of connecting bosses 107, 108. The reason will now be described.

Figure 2:
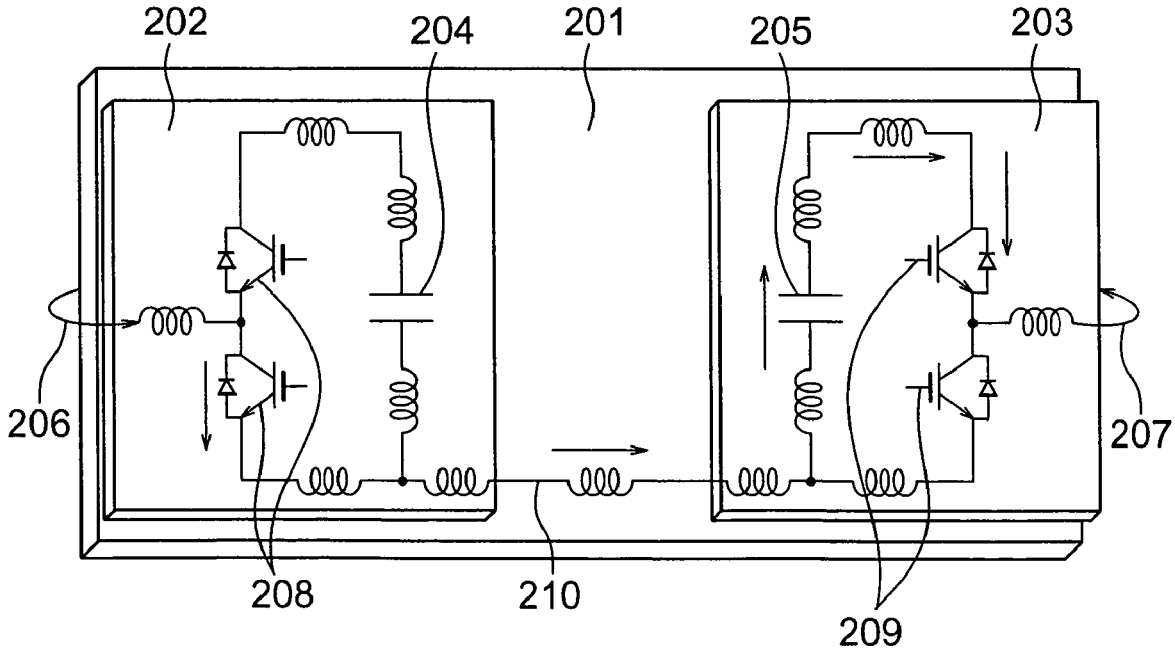
FIG. 2 is a diagram to explain a principle of the present invention.

FIG. 2 shows the plasma display apparatus, with a viewing surface of the apparatus (a front surface of the complete product) facing the bottom, viewed from a position above the apparatus. FIG. 2 shows an outline of the sustaining discharge drive circuit of the printed circuit boards in a pair and a simplified embodiment. The diagram shows only part of the drive circuit by removing members to support the plasma display apparatus and drive circuits not required for the description.

In the AC plasma display apparatus according to the present invention, three operations including "erase (reset)", "store (address)", and "display (sustaining discharge or sustain)" are conducted in a time-series way. The present invention is mainly associated with a sustaining discharge period.

In FIG. 2, a chassis 201 as an electric conductor is disposed at an deepest (lower-most) position. On a rear side (lower side in FIG. 2) of the chassis 201, a plasma display panel is arranged as a display section. The chassis 201 is a relatively thick plate of aluminum to support the plasma display panel, not shown, various circuits to drive the panel, and various wiring lines, partly shown, to connect the circuits to each other and the circuits to the panel. To use the display as a complete product, the chassis 201 is supported by supporting members, not shown, such as legs.

During the sustaining discharge period, a pulsated AC current is supplied to the overall panel having stored "display/non-display" (having been addressed) in advance to thereby flash the panel. For this operation, electrodes called an X-electrode and a Y-electrode (bus electrodes) are used. Connecting terminals, not shown, are arranged in an end portion in the longitudinal direction of the plasma display panel.

The circuit to supply a current to the terminals, i.e., the sustaining discharge drive circuit is configured on the Y-side sustaining discharge printed circuit board 202 and the X-side sustaining discharge printed circuit board 203. As described above, two sustaining discharge drive circuits may be disposed on one printed circuit board. The power source is a switching power source existing on another printed circuit board, not shown. However, the substantial power source of this circuit is the current sources, namely, a Y-side power supply capacitor 204 and an X-side power supply capacitor 205 which include electrolytic capacitors and film capacitors connected in parallel connection. The capacitors 204 and 205 serve as power sources for respective halves of the alternating current of the sustaining discharge current. FIG. 2 shows a phase in which the capacitor 205 is supplying the current. The current path is indicated by a bold line.

The current path will be described along the path. Since the X-side semiconductor switch 209 at an upper position is on and the switch 209 at a lower position is off, the current from a high side terminal, not shown, of the capacitor 205 passes through an upper path to flow through a connector, not shown, disposed in the proximity of an end portion of the X-side sustaining discharge printed circuit board 203 and reaches wiring 207 of the X-electrode of the panel. The wiring 207 to the panel X-electrode is a flexible printed circuit board which is a connecting printed circuit board connected to a connecting terminal, not shown, of an X-side electrode of the plasma display panel. The current which is fed from the X-electrode, not shown, of the panel as an extension of the connecting terminal of the X-side electrode and which is deliver to display cells, not shown, of the panel flows from a Y-electrode, not shown, of the panel and passes through a connecting terminal, not shown, of the Y-side electrode to wiring 206 (also a flexible printed circuit board) to the panel Y-electrode. The wiring 206 to the panel Y-electrode is linked to wiring in the Y-side sustaining discharge printed circuit board 202 using a connector, not shown, disposed in the vicinity of an end portion of the circuit board 202. Since the Y-side semiconductor switch 208 at an upper position is off and the switch 208 at a lower position is on, the current flows through a path on the lower side to a ground line. The current from the circuit board 202 reaches the circuit board 203 via a chassis conductive section 210 on the chassis and flows through ground wiring in the circuit board to a ground terminal, not shown, of the X-side power supply capacitor 205 to thereby completely form a loop. To supply the current from the circuit board 202 to the chassis and the current from the chassis to the circuit board 203, there are used fixing members, not shown, electrically connecting an end portion of each of the circuit boards to an end portion of the chassis.

In a subsequent phase, a current flows in an opposite direction. In this situation, the capacitor 204 serves as a power source. The current passes through the upper path of the switch 208, the wiring 206 to the panel Y-electrode, the panel, the wiring 207 to the panel X-electrode, the lower path of the switch 209, and the chassis conductive section 210 to return to the capacitor 204.

As indicated by coils in FIG. 2, each wiring line has inductance. The inductance varies according to various factors such as the wiring length, the wiring width, the wiring layout, presence or absence of adjacent wiring, and currents flowing through the wiring. When the wiring length is fixed, the wiring width, that is, broadening of the current is a factor to most effectively determine the inductance. In the sustaining discharge circuit described above, when all wiring lines in the panel are arranged in parallel connection, the inductance takes a value of about several hundred nano-Henry (nH). This section occupies a largest portion of the overall inductance. Excepting the section, the chassis conductive section 210, the circuit board 202, and the circuit board 203 respectively have large inductance values.

The chassis conductive section 210, like the wiring in the panel, has a width sufficiently large with respect to the length of the current flow. The inductance hence has an absolute value relatively small with respect to the length of the current flow. The current flows through the section 210 in a direction opposite to that of the current flowing through the panel. Therefore, using a cancel effect of inductance due to mutual inductance caused by the current flowing through the panel, the total inductance of the panel and the chassis conductive section 210 can be reduced to an extremely small value. In contrast, the wiring lines in the circuit boards 202 and 203 are attended with many restrictions in the arrangement of wiring lines, and each wiring line has high inductance with respect to its short wiring length. Additionally, in the wiring lines, there does not exist any effective inductance reducing structure similar to that of the panel and the section 210. According to the present invention, there is provided structure to efficiently cancel the inductance using the mutual inductance associated with the panel and the chassis conductive section 210. This also solves the problem of high inductance of the wiring lines in the circuit boards 202 and 203.

Figure 3A:
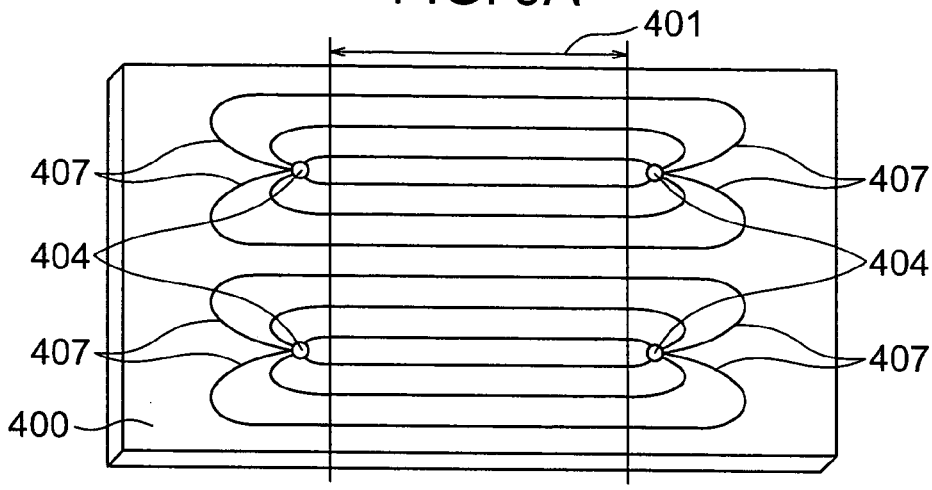
FIGS. 3A to 3C are diagrams to explain a principle of the present invention.
Figure 3B:
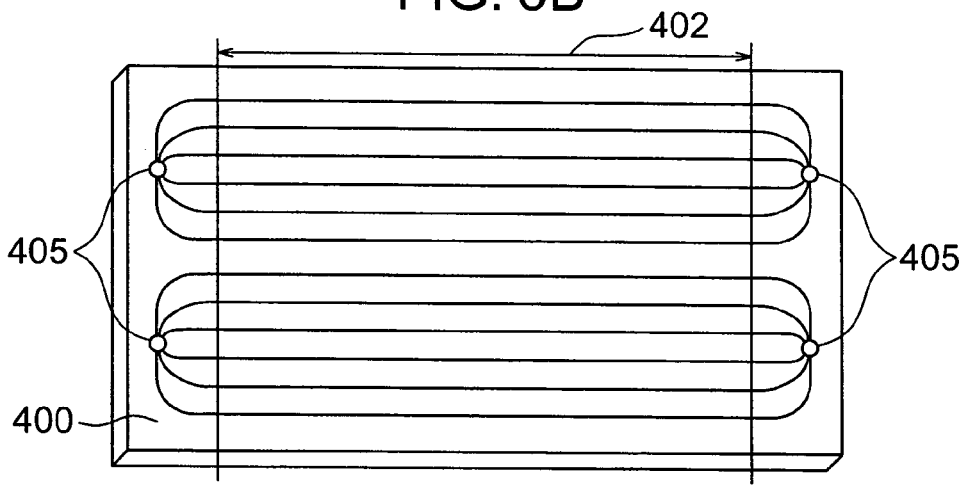
Figure 3C:
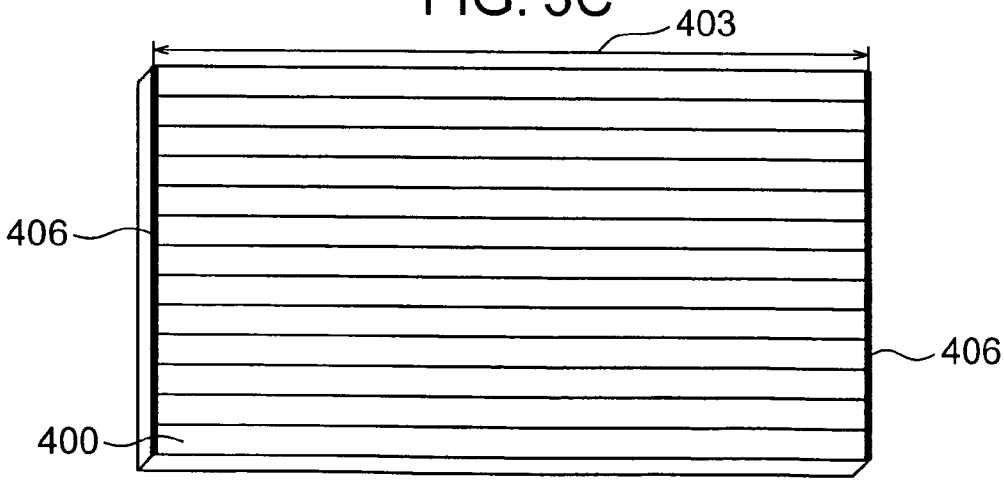

Referring now to FIGS. 3A to 3C, description will be given of a configuration to reduce inductance by increasing strength of magnetic coupling between the panel and the chassis conductive section. FIGS. 3A to 3C show currents in a chassis 400 in three cases of connection between the chassis 400 and the ground terminals of the ground level wiring of the sustaining discharge drive circuit in the sustaining discharge printed circuit board, not shown. In each of FIGS. 3A to 3C, current flows are indicated by 12 lines which are equal in a quantity of current to each other.

First, description will be given of a case of FIG. 3A in which the current is fed to the chassis 400 through current supply points or current terminals disposed near to each other. FIG. 3A includes four current terminals 404, i.e., two terminals 404 on each of the right-hand and left-hand sections. The left terminals 404 are respectively synchronized with the associated right terminals 404. That is, when a current is supplied from the two left terminals 404, a current flow into the associated two right terminals 404. In this layout, part of the current does not flow to the associated terminal 404 and flows in an opposite direction. This indicates existence of a reverse current 407. The current flow has a short parallel section 401. In this section, a current flows in a direction opposite to and parallel to the current in the panel, not shown. Therefore, inductance in the parallel section 401 is almost cancelled by the panel and the chassis 400. However, the cancel effect is small in the other sections. Particularly, the mutual inductance is positive in the reverse current section 407 and hence the total inductance exceeds the original inductance.

Next, when the points to flow the current to the chassis 400 are apart from each other (FIG. 3B) as compared with those of FIG. 3A, current terminals 405 are less apart from an edge of the chassis 400 and hence there does not exist a zone like the reverse current section 407 which explicitly increases the inductance. At the same time, the parallel section 402 is longer than the parallel section 401 and the inductance cancel effect is resultantly increased. Therefore, when compared with the configuration of FIG. 3A, the total inductance of the panel and the chassis 400 is reduced in the configuration of FIG. 3B.

Referring now to FIG. 3C, description will be given of a current supply line 406 to supply a current at an end section of the chassis 400. Unlike the preceding two examples, when the current is supplied at the end section in this example, a parallel section 403 extends up to an edge of the chassis 400. As a result, the mutual inductance of the sustaining discharge current flowing through the panel and that flowing through the chassis 400 takes a minimum value (the absolute value takes a maximum value). The total inductance of the panel and the chassis 400 approaches zero.

Description has been given of structure to reduce the total inductance of the panel and the chassis using the mutual inductance.

The present embodiment is associated with the current flow shown in FIG. 3B. To implement the current flow, a fixing member at a position near the central position of the aluminum chassis 116 is electrically insulated and a fixing member at a position near an end section of the aluminum chassis 116 is set to an electrically conductive state.

That is, the current flow between the printed circuit board and the chassis and that between the printed circuit board and the plasma display panel are implemented possibly at a position on one side of each of the printed circuit boards 101, 102 connected to each of connecting boards 107, 108. This increases the inductance cancel effect for the current path in the printed circuit board and the current path between the printed circuit board and the chassis or the plasma display panel, leading to a remarkable advantage of the mutual inductance to reduce the inductance.

In this connection, the proximity of the end section of the aluminum chassis for the connection of the fixing member to be electrically connected thereto is a range of an edge of the aluminum chassis, i.e., a range from 0 mm to about 240 mm relative to the edge; desirably, a range from 0 mm to 100 mm relative thereto.

Second Embodiment

Figure 4:
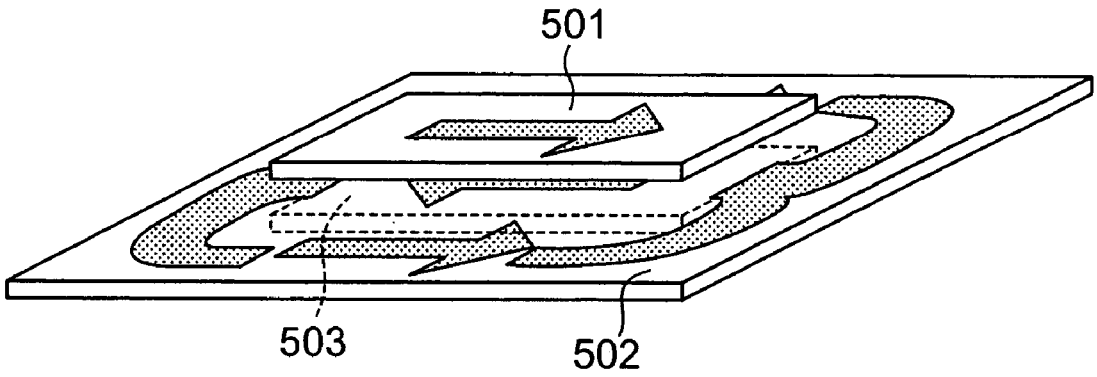
FIG. 4 is a diagram to explain a principle of the present invention.
Figure 5:
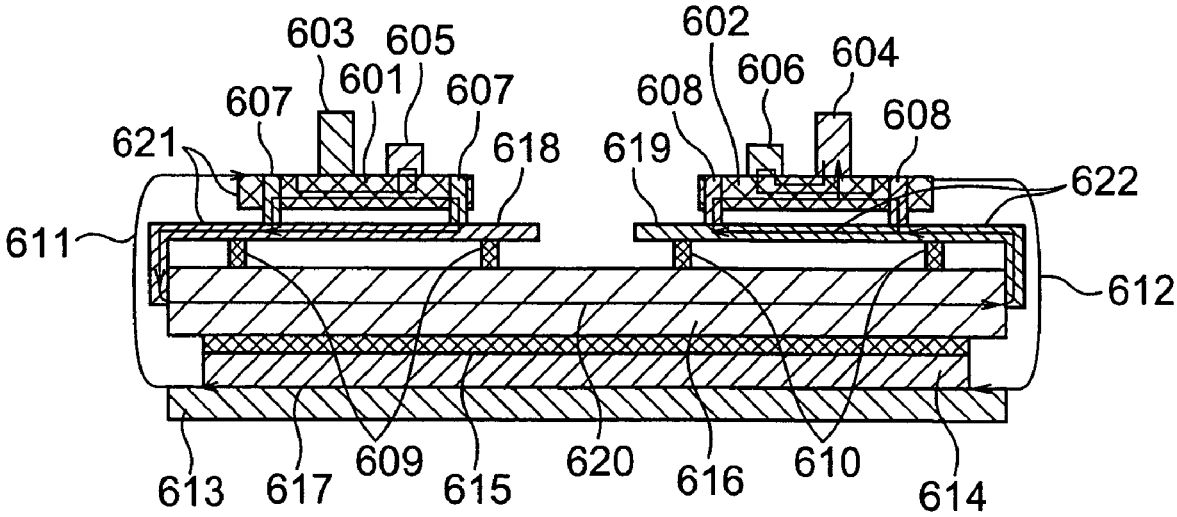
FIG. 5 is a cross-sectional view showing a cross section of a second embodiment of a plasma display apparatus according to the present invention.
Figure 6:
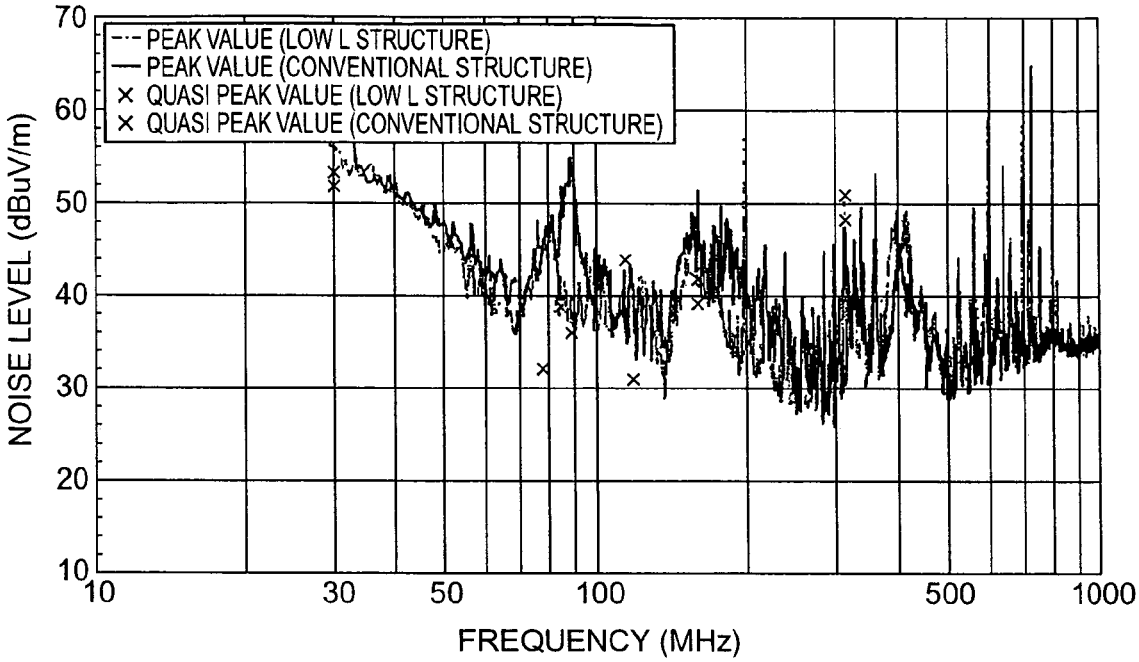
FIG. 6 is a graph to explain an advantage of the second embodiment of the present invention.

Referring to FIGS. 4 to 6, description will be given of a second embodiment of the present invention.

FIG. 5 shows a cross section of an overall configuration of the second embodiment of a plasma display apparatus. In FIG. 5, an arrow indicates a path of a sustaining discharge current and a direction thereof at a particular point of time. A big wide arrow indicates a section in which the current flows in a dispersed state (in a planar shape). A small narrow arrow indicates a section in which the current flows in a concentrated state (through a narrow route). According to a characteristic of inductance, inductance values of sections having a fixed length differ from each other depending on the current state. The inductance takes a large value when the current is dispersed and a small value when the current is concentrated.

The sustaining discharge current from a plus electrode, not shown, of an X-side power supply capacitor 604 as the current source passes through a semiconductor switch, i.e., an X-side semiconductor switch 606 and a wiring pattern of the X-side sustaining discharge printed circuit board 602 and flows to an X-side flexible printed circuit board 612 as a connecting printed circuit board. The current route up to this point is wiring in the printed circuit board, and hence the current flows in a concentrated state. The current enters the circuit board 612 and disperses into a planar shape. With the planar shape kept retained, the current passes through a bus electrode, not shown, disposed in a narrow space interposed between a front panel 613 and a rear panel 614, the bus electrode being on the side of a front panel 613. The current makes the panel to emit light and then passes through a Y-side flexible printed circuit board 611 to enter a Y-side sustaining discharge printed circuit board 601. The current is dispersed up to this point. In the circuit board 601, the current flows in a relatively narrow pattern. In this circuit board, the current is connected to ground level wiring by a Y-side semiconductor switch 605 and is fed to a Y-side conduction boss 607. The current from the boss 607 enters a conduction plate, i.e., a Y-side current regulating plate 618. In the plate 618, the current is dispersed and flows to a chassis 616 as indicated by a current 621 flowing through the plate 618. The plate 618 is fixed onto the chassis 616 by a member, i.e., a Y-side insulating spacer 609 which is electrically insulated. Since an insulating substance is used, the sustaining discharge current cannot flow through the section into the chassis 616. From the plate 618 which is an L-shaped conduction plate having both a long part and a short part, the short part being connected to the chassis 616 at an end section of the chassis 616, the long part being arranged in parallel with the chassis 616, the current flows into the chassis 616 with its dispersed state kept unchanged. A current 620 flowing through the chassis 616 almost uniformly spreads in an overall surface of the chassis 616 and flows substantially straight in one direction. The direction is opposite to that of a current 617 flowing through the panel. Since the current is connected in series to the current 617 flowing through the panel, these currents are substantially equal also in a current phase to each other. As a result, the current 617 through the panel and the current 620 through the chassis substantially completely cancel inductance. Therefore, inductance of this section becomes quite small. The entire sustaining discharge current from the chassis 616 having entered another L-shaped conduction plate 619 via a linear connecting section flows to an X-side conduction boss 608 with the dispersed state kept unchanged. Also in this situation, since the plate 619 is fixed onto the chassis 616 by an X-side insulating spacer 610, the current cannot flow from the chassis 616 into the X-side current regulating plate 619 through another current path. From the boss 607, the current flows in a concentrated state. The current passes through a ground pattern of the circuit board 602 to reach a minus electrode, not shown, of the X-side power supply capacitor 604 to thereby complete the path.

The gist of the present invention resides in a pair of conduction plates, i.e., the Y-side and X-side current regulating plates 618 and 619. In this connection, the term "regulating" is not used to indicate the conversion of an alternating current into a direct current, but the term indicates conversion of a current flowing through the chassis into a parallel current. The plates 618 and 619 primarily serve two functions.

The first function is as below. The plates 618 and 619 respectively lead the currents flowing respectively through the circuit boards 601 and 602 in a concentrated state to the chassis 616 in a dispersed state. The connecting section of each of the plates 618 and 619 to the chassis 616 is linearly dispersed, and hence the current 620 flowing through the chassis 616 can flow in a dispersed state from one edge of the chassis 616 to another edge thereof. This increases to the maximum extent the inductance cancel effect obtained by the current 2620 and the current 617 flowing through the panel. For this function, it is required that the current regulating plate is bent at a position corresponding to an end section of the chassis, and the plate has substantially same in size as the chassis in a direction vertical to the longitudinal direction of the chassis. The chassis is connected to the plate as below. A side surface or a surface of an end portion or section of the chassis is connected onto a side surface of an end portion of the plate or an upper or lower surface thereof so that the current flows through the overall surface to the maximum extent. In this arrangement, the current flowing through the plate in a state in which the current spreads on the surface of the plate flows into the chassis in this state (FIG. 3C). It is hence possible to increase the inductance cancel effect between the chassis and the plasma display panel to the maximum extent.

Description will next be given of a function to possibly increase the inductance cancel effect between the printed circuit board and the current regulating plate.

The second function of the plates 618 and 619 is to reduce inductance caused by wiring in the circuit boards 601 and 602.

Description will now be given of the structure for the reduction of inductance in the circuit boards by referring to FIG. 4 in comparison with FIG. 2, the reduction of inductance being attended with difficulty. A current path plate 501 corresponds to a simplified configuration of part of the wiring in the circuit board 202 or 203. A neighbor conduction plate 502 corresponds to the chassis 201. In a state in which the plates 501 and 502 are magnetically coupled with each other, when a current which changes with respect to time (indicated by an arrow in FIG. 4) flows through the plate 501, a current appears in a portion of the plate 502 overlapped with the plate 501, i.e., in an eddy current inducing section 503. The current has the same current phase as the current in the plate 501 and flows in a direction opposite to the current in the plate 501. Lines of magnetic force caused by the current in the section 503 has a direction to cancel lines of magnetic force caused by the current flowing on the plate 501. This consequently reduces the inductance of the plate 501. However, since it is required that the current occurring in the section 503 is terminated or closed within the neighbor conduction plate 502, the current flows through an outer or circumferential region of the section 503 in a shape of "8". Thanks to the circumferential region, the current fully appears in the section 503 and the inductance of the plate 501 is sufficiently reduced. For the magnetic coupling between the plates 501 and 502, it is necessary that the distance therebetween is small.

The current path plate 501 of FIG. 4 corresponds to the pattern in the circuit boards 601 and 602 and the neighbor conduction plate 502 of FIG. 4 corresponds to the current regulating plates 618 and 619. That is, inductance in the wiring of the circuit boards 601 and 602 is reduced by the eddy currents in the plates 618 and 619. This leads to a small inductance reducing effect in the numeric value when compared with the effect of the first function described above. However, this is an important function to reduce the inductance of the wiring in the printed circuit boards which have many restrictions in the operation to arrange patterns thereof.

A third function of the plates 618 and 619, namely, a shield effect is also available although its effect is smaller than those of the first and second functions. Magnetic fields in the circuit boards 601 and 602 are complicated and cause complex eddy currents on planar conductors existing in the vicinity of the circuit boards 601 and 602. This leads to an effect of reducing the inductance in the circuit boards 601 and 602. However, the eddy currents disturb the current flowing through the chassis. If the plates 618 and 619 are absent, the current 620 through the chassis is somewhat disturbed by an eddy current. However, when the plates 618 and 619 are disposed at an intermediate point, the disturbance of the current 620 is remarkably reduced.

For efficient use of the first to third functions, the Y-side and X-side current regulating plates 618 and 619 are desirably larger than the Y-side and X-side sustaining discharge printed circuit boards 601 and 602. Particularly, in the direction vertical to the longitudinal direction of the circuit boards, the plates 618 and 619 are possibly similar in size to the chassis 616 to sufficiently broaden the current. It is ideally desired that the plates 618 and 619 are equal in size to the chassis 616.

To efficiently achieve the second and third functions, it is required that the plates 618 and 619 are in the vicinity of the circuit boards 601 and 602 to the maximum extent and are apart from the chassis 616. As a result of verification through simulations and experiments, the distance between the plates 618 and 619 and wiring layers of the ground level wiring of the circuit boards 601 and 602 is desirably less than the distance between the plates 618 and 619 and the chassis 616. Also, the distance between the chassis 616 and a surface on the rear panel 614 side of the front panel 613 is desirably less than the distance between the chassis 616 and the plates 618 and 619.

The gist of the present invention resides in that the conduction plate and the current regulating plate are employed in the structure to achieve the two effects described above.

FIG. 6 shows, in a graph, experimental data used to verify the effect of the current regulating plate disposed in the embodiment. The data is obtained by measuring a vertical polarization portion of radiation noise in an electromagnetic shielded room. The noise of a plasma television including a plasma display apparatus according to the present invention is indicated by a thin broken line and the noise of a plasma television including a plasma display apparatus of a conventional configuration is indicated by a thick broken line.

The reduction of inductance by the effect of the present invention cannot be directly measured using a television set of a complete product. To directly measure improvement of performance necessary for the product, it is favorable to measure electromagnetic noise. Therefore, the noise measurement has been achieved. The abscissa represents a frequency of the electromagnetic wave and the ordinate represents a voltage gradient (intensity of the electromagnetic wave) in the space. The higher the point of the broken line is, the stronger the noise is.

Particularly, in a low-frequency zone equal to or less than 200 MHz, a noise reduction of about three decibel (dB) is obtained. Noise reduction in a high-frequency portion can be relatively easily obtained by disposing a shield. However, it is difficult to reduce noise in the low-frequency zone. According to the present invention, noise reduction is achieved in the low-frequency zone. This is a remarkable advantage of the present invention to obtain high picture quality.

Third Embodiment

Figure 7:
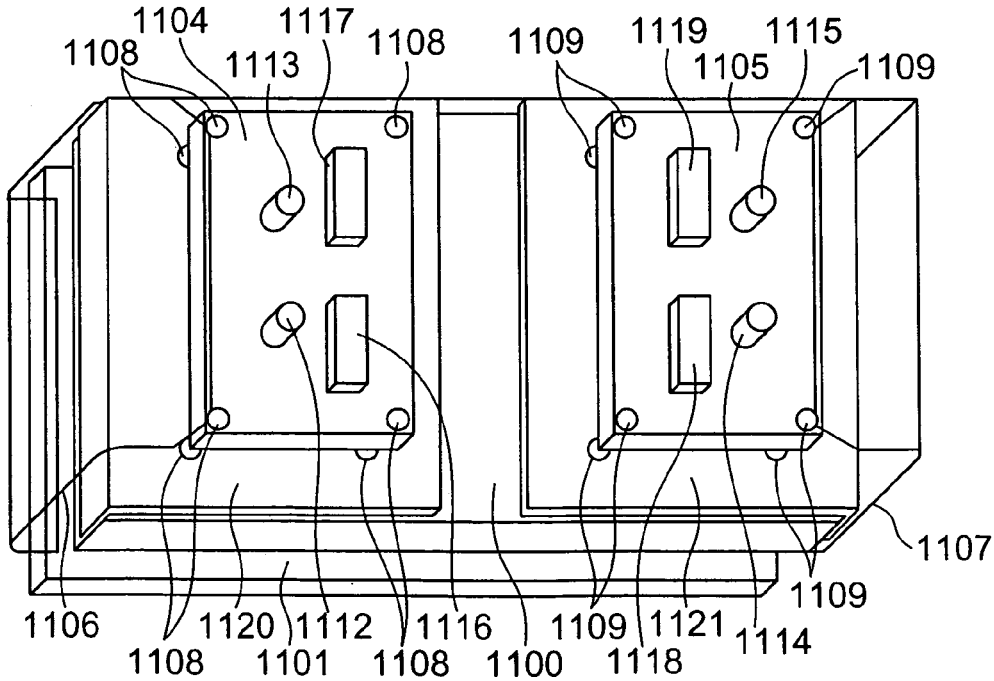
FIG. 7 is a perspective view showing an outline of a third embodiment of a plasma display apparatus according to the present invention.
Figure 8:
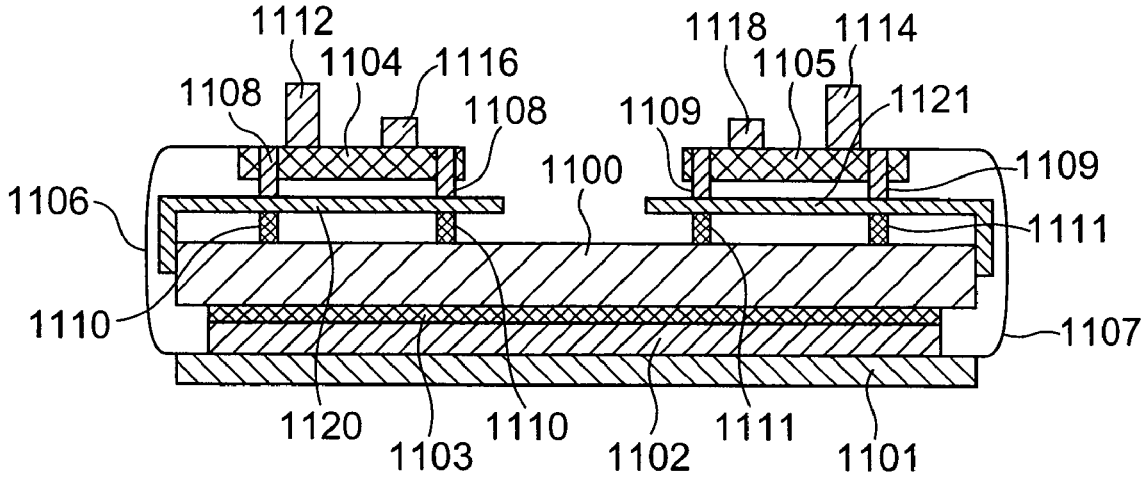
FIG. 8 is a cross-sectional view showing a cross section of the third embodiment shown in FIG. 7.

Referring now to FIGS. 7 and 8, description will be given of a third embodiment of the present invention.

FIG. 7 shows the third embodiment of a plasma display apparatus according to the present invention, with a display surface of the apparatus (a front surface of the complete product) facing the bottom side, viewed from a position above the apparatus.

The apparatus includes a plasma display panel including two sheets of glass. Of complete products of two sheets of glass, a rear side of a front-side panel (a front panel 1101) is shown in FIG. 7. On the rear side (opposing a rear panel 1102), an X-electrode and a Y-electrode, not shown, are formed for display. On a rear side (an upper side in FIG. 7) of the front panel 1102, the rear panel 1102 (not shown in FIG. 7), a two-side adhesive tape 1103 (not shown in FIG. 7), and an aluminum chassis 1100 (1.5 mm thick) are arranged. A complete product of the plasma display including the plasma display panel and an outer case, not shown, is entirely fixed onto the aluminum chassis 1100 which is an electric conductor. Since the display panel is large in size, the embodiment includes two sustaining discharge circuits to uniform the overall images displayed on the display panel. The respective circuits cover an upper-half section and a lower-half section of a screen of the display panel. On a Y-side sustaining discharge printed circuit board 1104, a Y-side power supply capacitor A 1112, a Y-side power supply capacitor B 1112, a Y-side semiconductor switch A 1116, and a Y-side semiconductor switch B 1117 are arranged. The circuit is further connected via a Y-side flexible printed circuit board 1106 to a Y-side electrode terminal, not shown, of the front panel 1101. Similarly, on an X-side sustaining discharge printed circuit board 1105, an X-side power supply capacitor A 1114, an X-side power supply capacitor B 1115, an X-side semiconductor switch A 1118, and an X-side semiconductor switch B 1119 are arranged. The circuit is further connected via an X-side flexible printed circuit board 1107 to an X-side electrode terminal, not shown.

FIG. 8 shows a cross section of FIG. 7 and includes a sustaining discharge current path similar to that described in conjunction with FIG. 5. On a rear side (an upper side in FIG. 8) of the front panel 1101, a rear panel 1102 is disposed. Gas is sealed in a space between these two plate of glass to produce plasma discharge therein. FIG. 8 also shows the two-side adhesive tape 1103 to fix the front and rear panels 1101 and 1102 onto the aluminum chassis 1100.

In the embodiment, an electric conductive two-side adhesive tape is used along an entire connecting section (end section) between a Y-side current regulating plate 1120 and an X-side current regulating plate 1121 and the aluminum chassis 1100 to transfer a current through an overall width in a linear direction.

The circuit boards 1104 and 1105 are four-layer printed circuit boards. Each circuit board is, for example, 312 mm in a vertical direction (in a perpendicular direction of a complete product) and 240 mm in a horizontal direction (in a horizontal direction of a complete product). Each of the plates 1120 and 1121 is, for example, 550 mm in a vertical direction and 300 mm in a horizontal direction. When viewed from a point just above the circuit boards (a point over the diagram in FIG. 7; a rear side when a complete product is in use), the Y-side current regulating plate 1120 below the circuit board 1104 remarkably extends beyond the circumference of the circuit board 1104 and the X-side current regulating plate 1121 below the circuit board 1105 remarkably extends beyond the circumference of the circuit board 1105. As described in conjunction with FIG. 4, this configuration is used to enhance return of an eddy current by securing the neighbor conduction plate 2. Specifically, the configuration and the dimensions of the circuit system are adopted to sufficiently increase the eddy current in the plates 1120 and 1121 by the magnetic field caused by the sustaining discharge current of each of the printed circuit boards. The dimension in the vertical direction is determined to be similar to the vertical dimension, i.e., 575 mm of the aluminum chassis to thereby broaden the current in an entire width thereof, in addition to a purpose of securing the eddy current.

The plates 1120 and 1121 are made of aluminum. Although copper may also be used, aluminum is selected in consideration of the production cost. The plates are 0.5 mm thick. Since inductance is rarely influenced by the thickness (electric resistance), the plates may be thinner. This thickness is determined because the plates of this thickness are not easily deformed, but are easy to handle.

The distance between a lower surface of the circuit board 1104 and an upper surface of the plate 1120 and that between a lower surface of the circuit board 1105 and an upper surface of the plate 1121 are 6 mm. Since it is required to insert parts and devices in the circuit boards 1104 and 1105, the distance is possibly reduced to a limit in consideration of such parts. The distance between lower surfaces respectively of the plates 1120 and 1121 and an upper surface of the aluminum chassis 1100 is 10 mm. To efficiently regulate the sustaining discharge current flowing through the chassis 1100, it is effective to increase the distance. However, the value of 10 mm is determined to possibly reduce the depth of the overall complete product.

A Y-side connecting boss 1108 and a Y-side cut-off boss 1110 are used as fixing members to fix the circuit board 1104 onto the chassis 1100, and an X-side connecting boss 1109 and an X-side cut-off boss 1105 are used as fixing members to fix the circuit board 1105 onto the chassis 1100. The bosses are arranged at four corners of the associated circuit boards 1104 and 1105. The bosses 1108 and 1110 are linked with each other using an equal axle, and the bosses 1109 and 1111 are linked with each other using an equal axle. This secures the fixing of the circuit boards 1104 and 1105 onto the chassis 1100. On the circuit boards 1104 and 1105, the wiring is implemented using a pattern having relatively small width, and hence inductance thereof is likely to increase. To reduce the inductance, it is desirable to reduce the distance between each of the capacitors 1112 and 1113 and the boss 1108 and the distance between each of the capacitors 1114 and 1115 and the boss 1109.

Fourth Embodiment

Figure 9:
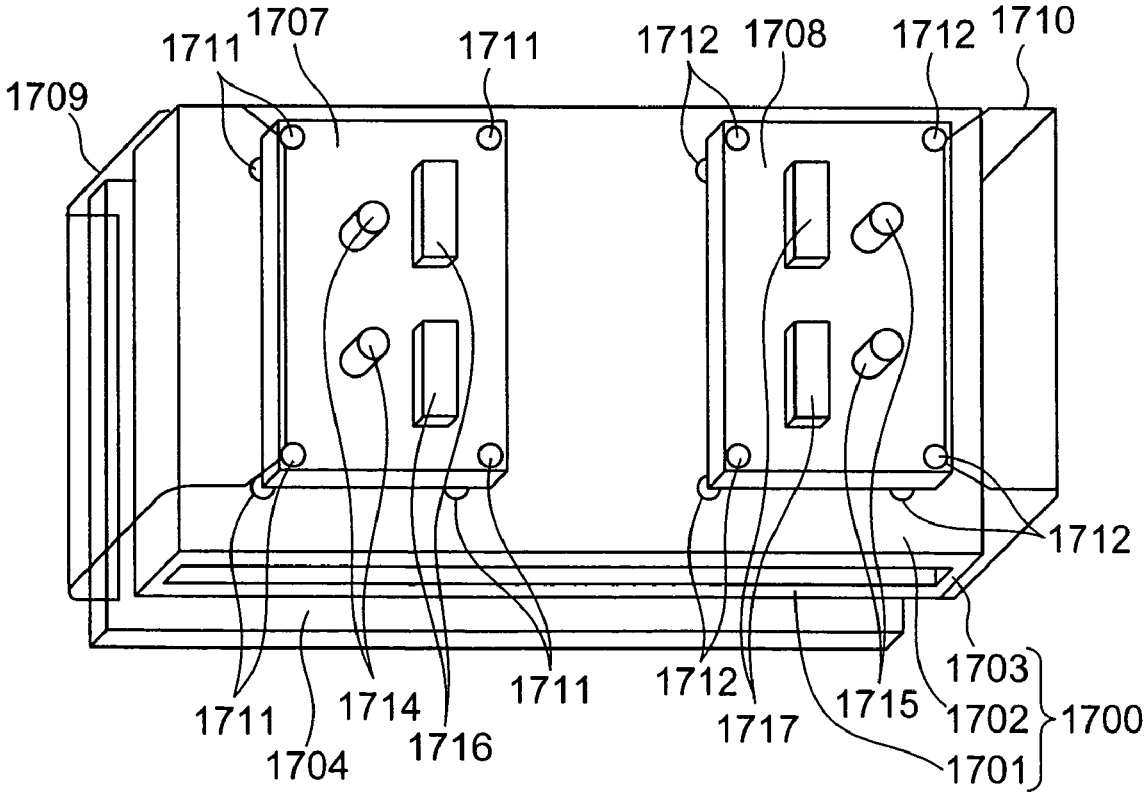
FIG. 9 is a perspective view showing an outline of a fourth embodiment of a plasma display apparatus according to the present invention.
Figure 10:
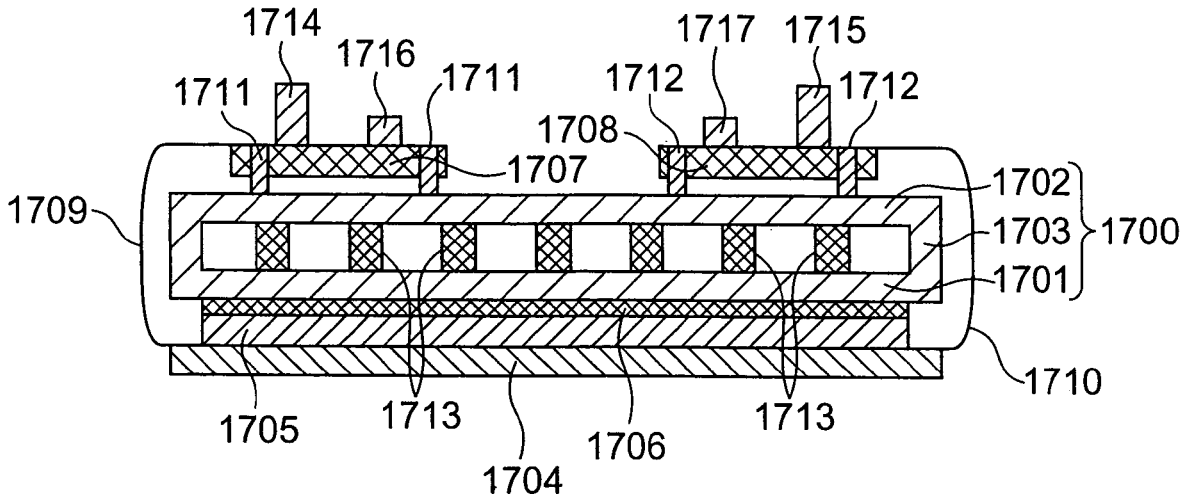
FIG. 10 is a cross-sectional view showing a cross section of the fourth embodiment shown in FIG. 9.

Referring now to FIGS. 9 and 10, description will be given of a fourth embodiment of the present invention.

FIG. 9 shows the fourth embodiment of a plasma display apparatus according to the present invention, with a display surface of the apparatus (a front surface of the complete product) facing the bottom side, viewed from a position above the apparatus. FIG. 10 shows a cross section of FIG. 9.

The fourth embodiment differs from the third embodiment in the configuration of an aluminum chassis as an electric conductor. While the chassis of the third embodiment is a plate of aluminum, the chassis 1700 has a shape of a rectangular pipe having a hollow zone, i.e., a gap. The gap extends in a direction vertical to the longitudinal direction of the chassis 1700.

The plate is 1 mm thick. The hollow zone (gap) is 10 mm high (the distance between a surface of the panel side chassis 1701 on an inner side of the chassis 1700 and a surface the drive circuit side chassis 1702 on an inner side of the chassis 1700). The distance between a surface of the chassis 1702 on an outer side of the chassis 1700 and surfaces respectively of a Y-side sustaining discharge printed circuit board 1707 and an X-side sustaining discharge printed circuit board 1708 on an outer side of the chassis 1700 is 6 mm. The distance between a surface of the chassis 1701 on an outer side of the chassis 1700 and a surface of a front panel 1704 on the side a rear panel 1705 is 4 mm. The chassis 1700 has an opening at an upper end and a lower end thereof. The chassis 1701 and 1702 are electrically connected to each other by a chassis connecting section 1703 existing only on the right and left sides of the panel. To make the chassis 1701 and 1702 one body (to prevent unnecessary vibration), a plurality of insulating members are used (at about 40 positions), i.e., connecting portions of facing chassis 1713 to mechanically fix the chassis 1701 and 1702 onto each other.

The chassis 1700 as a whole serve functions of the chassis 1100 and the plates 1120 and 1121 of the third embodiment. Specifically, the chassis 1701 (first conductor) serves as the chassis 1100, and the chassis 1702 (second conductor) serves as the plates 1120 and 1121.

Description will now be given of a flow of the sustaining discharge current flowing in the same direction as the sustaining discharge current of the third embodiment. For simplicity, two current paths will be comprehensively described at a time. A current from a current source, i.e., an X-side power supply capacitor 1715 passes through an X-side semiconductor switch 1717, a connecting printed circuit board, i.e., an X-side flexible printed circuit board 1710, a front panel 1704 of the plasma display panel, and a Y-side flexible printed circuit board 1709 to a Y-side sustaining discharge printed circuit board. The current is fed by a Y-side semiconductor switch 1716 to pass a Y-side electric connecting boss 1711 connected to a ground terminal and reaches the chassis 1702. The current almost entirely flows in a direction to an edge of the panel, i.e., to the left-hand side in the diagram. Unlike the plates 1120 and 1121, the chassis 1702 is not separated at a central portion of the panel. The current nevertheless flows in a direction to the edge of the panel, not to the central portion thereof. Naturally, quite a small quantity of the current flows toward the central portion. However, the current is at a level not to affect the overall operation. This is an aspect of the third embodiment. By a magnetic field generated by the sustaining discharge current (in the form of a parallel current from the right to the left) flowing through bus wiring, not shown, as an X-electrode and a Y-electrode of the front panel 1704, the current is driven to flow in a direction from the left to the right to the chassis 1701. In association therewith, a current from the boss 1711 to the chassis 1702 flows via the connecting portion 1703 to the chassis 1701. The fourth embodiment seems to structurally differ from the third embodiment. However, functionally, the fourth embodiment is almost the same as the third embodiment. The current having passed through the chassis 1701 in the direction from the left to the right flows through the connecting portion 1703 on the right side to the chassis 1702. The current passes through the boss 1712 to ground level wiring of the circuit board 1708 and reaches the capacitor 1715 to thereby complete a current loop.

In the third embodiment, since the paired conductors, i.e., the plates 1120 and 1121 are not directly connected to each other, it is impossible for a current to flow from the plate 1120 to the plate 1121 and vice versa. In the embodiment, the flow of the sustaining discharge current changes depending on three distances between three surfaces including a distance between surfaces of the chassis 1701 and 1702, a distance between surfaces of the circuit boards 1707 and 1708 and a surface of the chassis 1702, and a distance between surfaces of the front panel 1704 and the chassis 1701. Depending on cases, a considerably large portion of the sustaining discharge current flows from the circuit board 1707 to the circuit board 1708 and vice versa only through the chassis 1702. Such a current flow increases the inductance of the overall sustaining discharge current circuit.

To prevent such a situation to secure the preferable current flow, it is required that the distance between a surface of the chassis 1701 on an outer side of the chassis 1700 and the side surfaces of the front and rear panels 1704 and 1705 and the distance between a surface of the chassis 1702 on an outer side of the chassis 1700 and wiring forming surfaces of the circuit boards 1707 and 1708 are less than the distance between a surface of the chassis 1701 on an inner side of the chassis 1700 and a surface of the chassis 1702 on an inner side of the chassis 1700. That is, the distance (height) of the aluminum chassis is more than the distance between the surface of the aluminum chassis and the surfaces of the circuit boards. Also, the distance of the aluminum chassis is more than the distance between the surfaces of the aluminum chassis and the plasma display panel.

This is because it is necessary that magnetic coupling between the chassis 1701 and the bus wiring of the front panel 1704 and magnetic coupling between the chassis 1702 and the circuit board 1707 or 1708 are stronger than magnetic coupling between the chassis 1701 and 1702.

It is essential in the embodiment to prevent a short circuit from occurring in the sustaining discharge current circuit. That is, the chassis 1701 and 1702 are electrically connected to each other only via the chassis connecting sections 1703 at the right and left edge sections of the aluminum chassis 1700. In other words, it is to be avoided to electrically connect the chassis 1701 and 1702 to each other at any position other than the right and left edge sections. To secure the strength between the surfaces, the connecting portions of facing chassis 1713 are made of an insulating substance other than metal.

The embodiment uses the aluminum chassis 1700 formed in a single body having the shape of a bag. However, the chassis 1700 is not restricted by the embodiment, any electrically equivalent item can be used. As a variation of the fourth embodiment, it is also possible that the Y-side and X-side current regulating plates 1120 and 1121 of the third embodiment are connected to each other at a central region of the panel. The connection is established therebetween for a mechanical connection to enhance strength, not for an electric connection. It is not required that all surfaces of the connecting sections therebetween are electrically connected. An insulating substance may be used to establish the connection, or one or several rod-shaped metallic items may be used for this purpose. It is also possible that the chassis 1702 has a complex configuration, not a configuration including substantially only one metallic plate. For example, the complex configuration includes metallic constituent components or includes metallic and insulating constituent components. In this situation, the aluminum chassis 1100 of the third embodiment corresponds to the panel side chassis 1701. Therefore, it is required that the member includes substantially only one metallic plate.

The embodiment includes a plurality of connecting portions of facing chassis 1713 as members to fix the chassis 1701 and 1702 onto each other. However, it is not particularly required that the portions are separated from each other, that is, the gaps between the portions 1713 may also be filled with an insulating member. This leads to an advantage that rigidity of the aluminum chassis 1700 is increased.

Contrarily, there may also be considered a variation of the embodiment by positively using the gap between the chassis 1701 and 1702. The variation has an advantage with respect to a thermal characteristic. The aluminum chassis 1700 is in the shape of a rectangular pipe. When the complete product thereof is in use, there exist an opening on the upper end and an opening at a lower end. That is, the chassis 1700 is in a state of an oval-shaped chimney. Therefore, when air in the space surrounded by the chassis 1701 and 1702 and the chassis connecting section 1703 of the chassis 1700 is heated, an ascending air current takes place. This serves as an air cooler. To enhance the air-cooling function, it is desirable to align the portions 1713 in a vertical direction, not to disperse the portions 1713 at random. The panel generates a large quantity of heat by the sustaining discharge. Such heat can be efficiently dissipated using the configuration.

Fifth Embodiment

Figure 11:
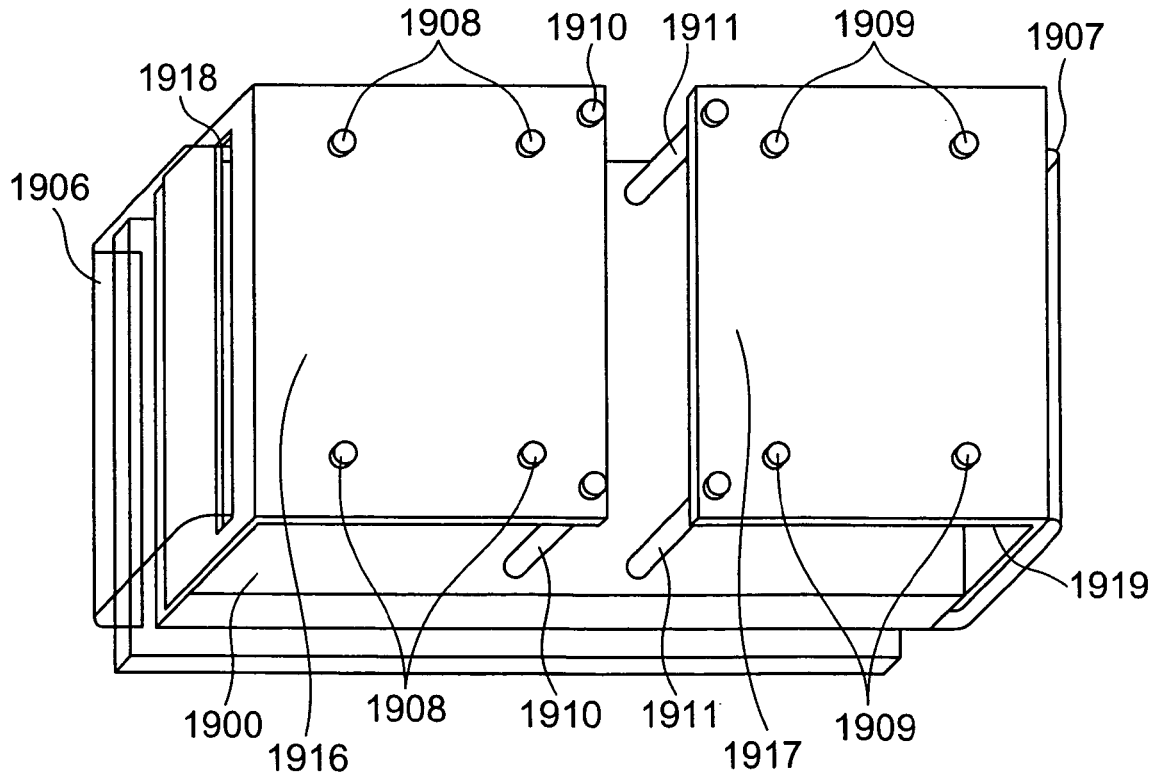
FIG. 11 is a perspective view showing an outline of a fifth embodiment of a plasma display apparatus according to the present invention.
Figure 12:
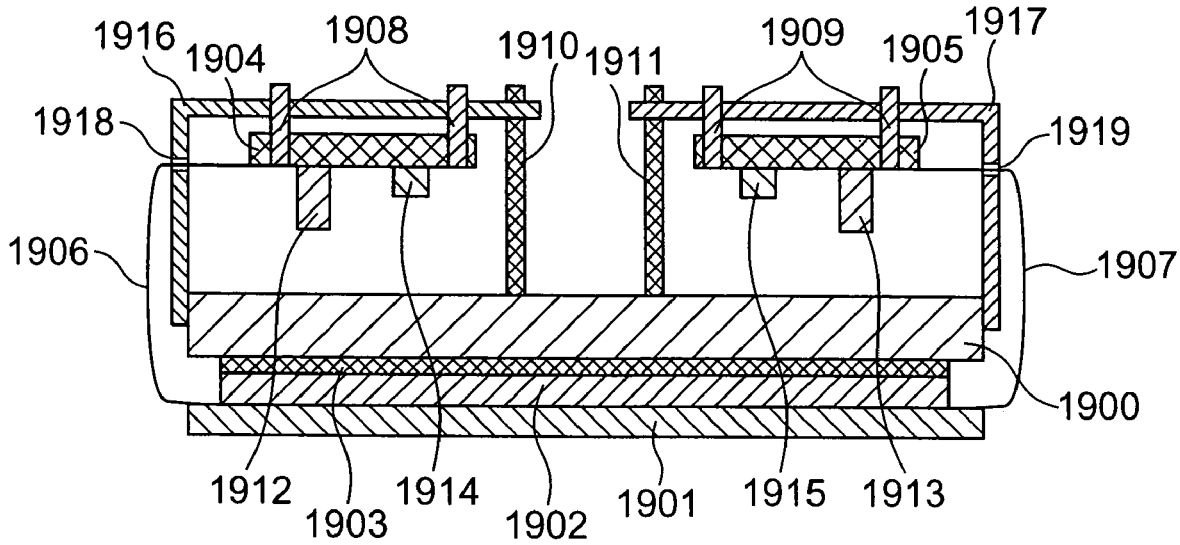
FIG. 12 is a cross-sectional view showing a cross section of the fifth embodiment shown in FIG. 11.

Referring now to FIGS. 11 and 12, description will be given of a fifth embodiment of the present invention.

FIG. 11 shows the fifth embodiment of a plasma display apparatus according to the present invention, with a display surface of the apparatus (a front surface of the complete product) facing the bottom side, viewed from a position above the apparatus. FIG. 12 shows a cross section of FIG. 11.

The fifth embodiment differs from the third embodiment in that a pair of printed circuit boards, namely, a Y-side sustaining discharge printed circuit board 1904 and an X-side sustaining discharge printed circuit board 1905 are placed between an aluminum chassis 1900 as a conductor and a pair of electric conductive plates, namely, a Y-side current regulating plate 1916 and an X-side current regulating plate 1917. That is, with respect to the paired printed circuit boards, the paired conduction plates are arranged on a side opposite to the side on which the plasma display panel is disposed. The paired conduction plates are electrically connected via a fixing member to the paired circuit boards. When compared with the other embodiments, the positional relationship between the current regulating plates and the printed circuit boards is reversed in this embodiment.

As already described, since it is required that the circuit boards 1904 and 1905 are in the vicinity of the Y-side and X-side current regulating plates 1916, the positional reversion described above is not sufficient. It is required that surfaces of the circuit boards 1904 and 1905 on which parts or devices are not mounted face the plates 1916 and 1917. For this purpose, the device mounted surfaces of the circuit boards 1904 and 1905 are arranged to face the aluminum chassis 1900. The direction of the circuit boards is opposite to that of the third embodiment.

A Y-side flexible printed board 1906 connecting the circuit board 1904 to a Y-electrode, not shown, of a front panel 1901 and an X-side flexible printed board 1907 connecting the circuit board 1905 to an X-electrode, not shown, of the front panel 1901 cross or intersect the Y-side and X-side current regulating plates 1916 and 1917. Therefore, a Y-side slit for crossing 1918 is disposed in the plate 1916 and an X-side slit for crossing 1919 is disposed in the plate 1917 to achieve the crossing of wiring.

To achieve the crossing, the circuit boards 1906 and 1907 may be subdivided into partitions. To provide holes in the plates 1916 and 1917, there may be used another method, different from that of the embodiment in which one big hole is provided, to dispose a plurality of small holes. In either cases, there is required appropriate structure for the crossing of wiring.

When there exists crossing, a narrow portion appears in the current flow path and hence increases inductance. Even when the inductance is increased as above, the structure described above is advantageous in that electromagnetic noise is reduced.

The advantage is associated with presence of a counter loop of wiring. FIG. 12 shows three big current loops. A current loop (first loop) includes a sustaining discharge current through the front panel 1901 and a sustaining discharge current through the aluminum chassis 1900 which exist in a portion on the panel side of the crossing section between the circuit boards 1906 and 1907. A current loop (second loop) includes a sustaining discharge current through the circuit board 1904 and a sustaining discharge current through the plate 1916 which exist in a portion on the side of the circuit board 1904 of the crossing section of the circuit board 1906. A current loop (third loop) includes a sustaining discharge current through the circuit board 1905 and a sustaining discharge current through the plate 1917 which exist in a portion on the side of the circuit board 1905 of the crossing section of the circuit board 1907. The first loop is opposite in the current direction to the second and third loops. That is, a magnetic field generated by the first loop is opposite in the direction of lines of magnetic force to magnetic fields generated by the second and third loops to cancel each other. Thanks to the cancellation of magnetic fields generated in the overall plasma display apparatus, the resultant magnetic field is considerably weak. This means that electromagnetic noise leaking from the apparatus is reduced.

As can be seen from FIG. 11, the Y-side and X-side current regulating plates 1916 and 1917 are disposed outside the apparatus, and the sources of electromagnetic noise, i.e., the circuit boards 1904 and 1905 are not exposed directly to the outside. The plates 1916 and 1917 are at ground-level potential and absorb electromagnetic noise generated by the circuit boards 1904 and 1905 to advantageously reduce electromagnetic noise emitted to the outside.

Sixth Embodiment

Figure 13:
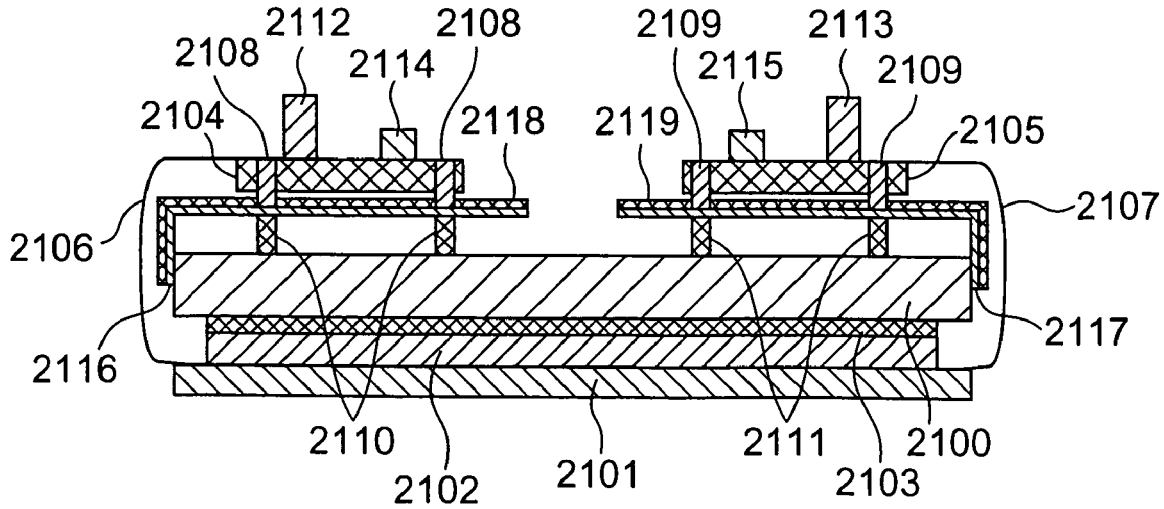
FIG. 13 is a cross-sectional view showing a cross section of a sixth embodiment of a plasma display apparatus according to the present invention.

Referring now to FIG. 13, description will be given of a sixth embodiment of the present invention.

FIG. 13 shows a cross section of the sixth embodiment of a plasma display apparatus according to the present invention. The lower side of FIG. 13 corresponds to a display surface (a front surface) of the complete product.

The sixth embodiment is a variation of the third embodiment. That is, to further secure the advantage of the third embodiment, the Y-side and X-side current regulating plates 1120 and 1121 are less apart from the Y-side and X-side sustaining discharge printed circuit boards 1104 and 1105 in the fourth embodiment. As above, the less the distance between the current regulating plate and the printed circuit board is, the lower the inductance in the printed circuit board becomes. However, since devices having certain height are mounted on or inserted in the printed circuit board, it is only possible in an actual configuration that the distance takes a minimum value of about 5 mm.

To overcome the difficulty, a portion of the plate 2116 facing the circuit board 2104 and a portion of the plate 2117 facing the circuit board 2105 are covered with a film of an insulating substance. That is, an insulation layers (Y-side current regulating plate insulation layer 2118 and an X-side current regulating plate insulation layer 2119) are disposed between the current regulating plates and the associated printed circuit boards.

The insulation layers 2118 and 2119 are made of a commonly used organic resin, not a particular substance. Since the layers are sufficiently thick, i.e., 0.5 mm thick, even when a tip of a device mounted on the circuit boards sticks the layers, electric isolation is not affected. As a result, the distance between surfaces respectively of the plate 2116 and the circuit board 2104 and that between surfaces respectively of the plate 2117 and the circuit board 2105 can be considerably reduced to about 1 mm.

In a variation of the fourth embodiment, by forming an insulation film on a surface of the chassis 1702 of the fourth embodiment, the distance between the circuit boards 1707 and 1708 and the chassis 1702 can be much more reduced.

Also in the fifth embodiment, by coating the plates 1916 and 1917 with an insulation film, the distance between the circuit board 1904 and the plate 1916 and that between the circuit board 1905 and the plat 1917 can be further reduced.

Seventh Embodiment

Figure 14:
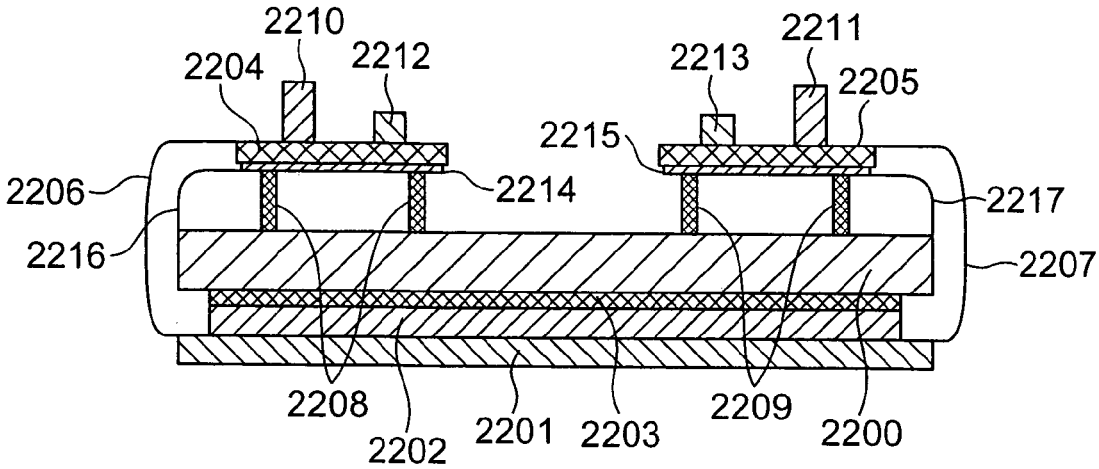
FIG. 14 is a cross-sectional view showing a cross section of a seventh embodiment of a plasma display apparatus according to the present invention.

Referring now to FIG. 14, description will be given of a seventh embodiment of the present invention.

FIG. 13 shows a cross section of the sixth embodiment of a plasma display apparatus according to the present invention. The lower side of FIG. 13 corresponds to a display surface (a front surface) of the complete product.

The seventh embodiment is implemented on the basis of the sixth embodiment. That is, the distance between the current regulating plate and the sustaining discharge printed circuit board is further reduced such that the current regulating plate is a conduction layer of the circuit board.

As a result, the distance between surfaces respectively of a Y-side current regulating layer 2214 and a Y-side sustaining discharge printed circuit board 2204 is almost equal to the distance between wiring layers in the circuit board 2204. The distance is about 0.5 mm. This also applies to the distance between surfaces respectively of an X-side current regulating layer 2215 and an X-side sustaining discharge printed circuit board 2205. In this state, the connection to an aluminum chassis 2200 cannot be established. Therefore, a Y-side current regulating flexible printed circuit board 2216 and an X-side current regulating flexible printed circuit board 2217 as connecting members are connected using connectors similar to those used for a Y-side flexible printed circuit board 2206 and an X-side flexible printed circuit board 2207. Although each of the members may be made of a simple metallic plate or metallic foil, a flexible printed circuit board is used in consideration of favorable structural matching with respect to the connectors on the printed circuit boards.

The inductance reduction effect is less sensitive to the resistance value of the electric conductive members (the layers 2214 and 2215 in the configuration) generating an eddy current. That is, a thick metallic plate like that used in the third embodiment is not necessarily required. The inductance reduction effect is kept unchanged by use of one layer (35 micrometer (μm) thick) of the printed circuit boards. Since the distance to the wiring layer is reduced, the inductance reduction effect is advantageously increased. However, there also exists a drawback. As described above, constituent components or devices are mounted on the circuit boards 2204 and 2205. Therefore, many copper foil patterns (through holes) are present in the circuit boards, the holes passing through the front and rear surfaces of the circuit boards. Through holes are also used for wiring between layers in the printed circuit boards. The through holes have various potential levels. It is required that through holes other than those of ground-level wiring connected to the layers 2214 and 2215 are electrically insulated. As a result, there cannot be obtained a completely flat conduction film. It is not possible to obtain a complete conductive plate, and hence the inductance reduction effect is reduced.

There also exists a restriction on the size in the planar direction. In the third to sixth embodiments, the current regulating plate is slightly larger in size than the sustaining discharge printed circuit board. In the configuration, a perpendicularly projected surface of the plate onto the chassis covers a perpendicularly projected surface of the circuit board onto the chassis. There hence exists a sufficient space for an eddy current to draw a loop as in the neighbor conduction plate 502 of FIG. 4. In this connection, since the current regulating plate is substantially equal in size to the printed circuit board in the seventh embodiment, the configuration is disadvantageous in consideration of the drawing of the loop by the eddy current. However, it does not occur in actual wiring that the pattern through which the sustaining discharge current flows in the printed circuit board has a contour almost equal to that of the printed circuit board. That is, a considerably large space remains in a periphery of the printed circuit board in many cases. Therefore, in the seventh embodiment, the effect of remarkable reduction in the distance between the current regulating plate and the printed circuit board more remarkably contributes to the advantage of the present invention. Therefore, the inductance reduction effect is fully developed.

Eighth Embodiment

Figure 15:
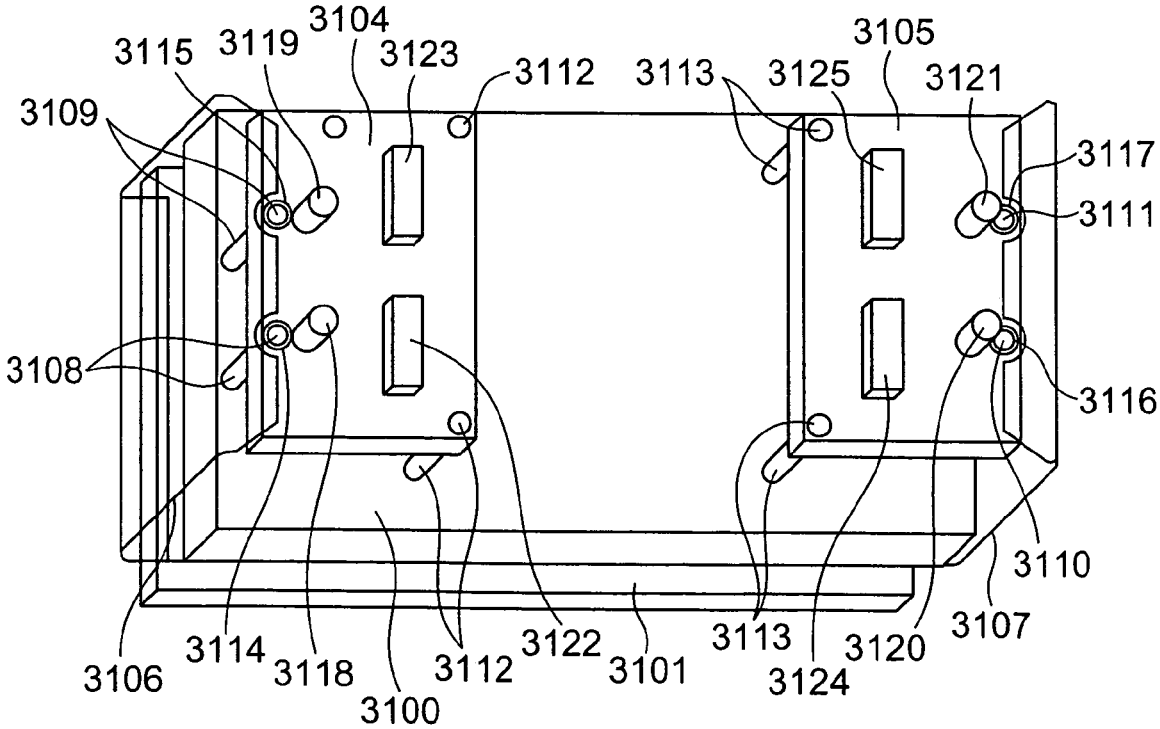
FIG. 15 is a perspective view showing an outline of an eighth embodiment of a plasma display apparatus according to the present invention.
Figure 16:
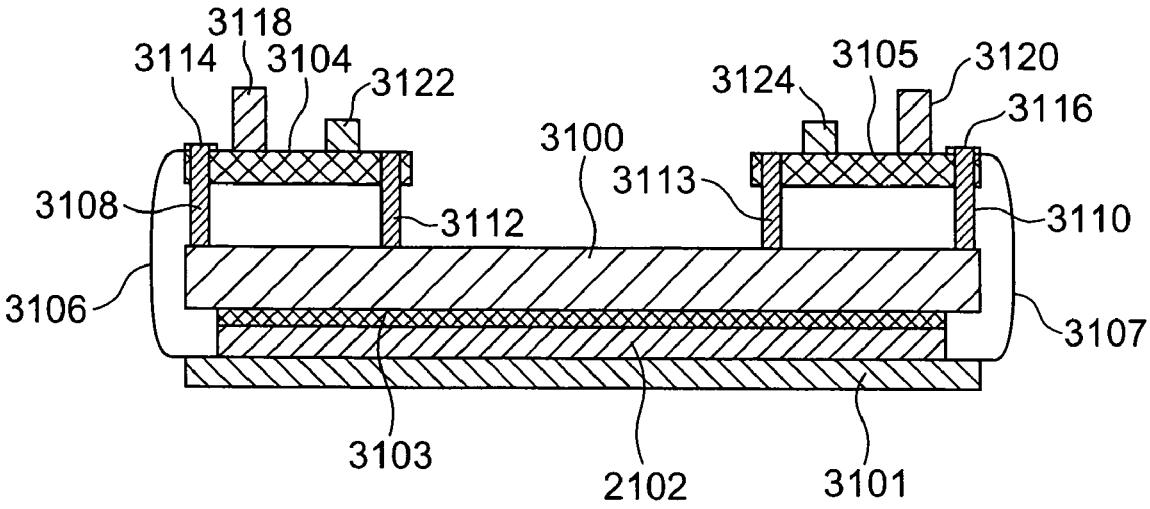
FIG. 16 is a cross-sectional view showing a cross section of the eighth embodiment shown in FIG. 15.

Referring to FIGS. 15 and 16, description will be given of an eighth embodiment of the present invention.

FIG. 15 shows a perspective view showing a plasma display panel and a driver circuit of the panel, viewed from a rear side thereof.

The plasma display panel includes two plates of glass. FIG. 15 shows a rear side of one of the two plates, i.e., a panel on a front side (front panel 3101). In the front panel 3101, there are formed an X-electrode and a Y-Electrode for display, not shown. On a rear side (an upper side in the diagram) of the panel 3101, a rear panel 3102, not shown, and a two-side adhesive tape 3103, not shown in FIG. 15, are disposed. On a rear side of the tape 3103, an aluminum chassis 3100 is arranged. The plasma display including the plasma display panel and an outer case, not shown, are entirely fixed onto the aluminum chassis 3100. On a Y-side sustaining discharge printed circuit board 3104, there are arranged a Y-side power supply capacitor A 3118, a Y-side power supply capacitor B 3119, a Y-side semiconductor switch A 3122, and a Y-side semiconductor switch B 3123. The switch B 3123 is connected via a Y-side flexible printed circuit board 3106 to a Y-side electrode terminal, not shown, of the front panel 3101. Similarly, on an X-side sustaining discharge printed circuit board 3105, there are arranged an X-side power supply capacitor A 3120, an X-side power supply capacitor B 3121, an X-side semiconductor switch A 3124, and an X-side semiconductor switch B 3125. The switch B 3125 is connected via an X-side flexible printed circuit board 3107 to an X-side electrode terminal, not shown. In the eighth embodiment, when compared with the semiconductor switches, the capacitors as the current sources are disposed less apart from an end portion of the plasma display.

FIG. 16 shows a cross section of FIG. 15. On a rear side (an upper side in FIG. 17) of the front panel 3101, the rear panel 3102 is disposed. Gas is sealed in a space between these two plates of glass to cause plasma discharge. FIG. 16 also shows the two-side adhesive tape 3103 as an adhesive sheet to fix the front and rear panels 3101 and 3102 onto the aluminum chassis 3100.

Description will now be given of an aspect of the eighth embodiment, i.e., a device arrangement of the Y-side and X-side sustaining discharge printed circuit boards 3104 and 1305. Each of the circuit boards 3104 and 1305 has a rectangular shape, i.e., 200 mm long in a horizontal direction and 250 mm long in a vertical direction. A Y-side electric connecting boss A 3108, a Y-side electric connecting boss B 3109, an X-side electric connecting boss A 3110, and an X-side electric connecting boss B 3111 which serve as a current path are arranged at outer-most positions of the circuit boards 3104 and 3105, i.e., positions nearest to the circuit boards 3106 and 3107. A capacitor serving substantially as a power source, i.e., the capacitor A 3118 is disposed in the vicinity of the boss A 3108. In the eighth embodiment, the distance between the central positions thereof is about 50 mm. Similarly, the capacitor B 3119, the capacitor A 3120, and the capacitor B 3121 are arranged in the vicinity of (about 50 mm apart from) the boss B 3109, the boss A 3110, and the boss B 3111. The switch A 3122, the switch B-3123, the switch A 3124, and the switch B 3125 are arranged at positions near the central position of the aluminum chassis 3100, i.e., about 100 mm apart from the respective power sources or capacitors. A relative angle between these constituent components is substantially horizontal, and these components are arranged substantially in a row. That is, for example, the central positions of the boss A 3108, the capacitor A 3118, and the switch A 3122 in the circuit board 3104 are equally apart from an end portion of the circuit board 3104 on its longer-edge side. The distance between a position at which the current source, i.e., the capacitor is connected to the sustaining discharge printed circuit board and a position at which a fixing member electrically connected to the aluminum chassis is connected is at most half the short-edge length of the sustaining discharge printed circuit board.

Ninth Embodiment

Description will now be given of a ninth embodiment of the present invention.

Figure 17:
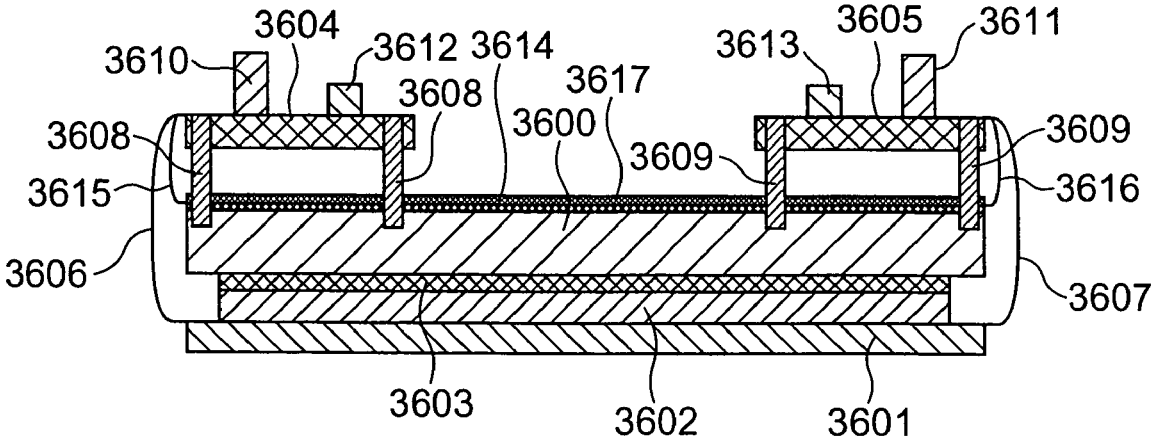
FIG. 17 is a cross-sectional view showing a cross section of a ninth embodiment of a plasma display apparatus according to the present invention.

FIG. 17 shows a cross section of a plasma display panel and a driver circuit thereof in the ninth embodiment of the present invention.

Description will be given only of aspects of the ninth embodiment while avoiding duplicated description of the same constituent components as those of the eighth embodiment. The ninth embodiment differs from the eighth embodiment in that a conduction sheet 3614 is disposed in the ninth embodiment. The sheet 3614 is arranged on a surface on a side of the aluminum chassis opposite to a surface of the chassis on which the plasma display panel is disposed, namely, on a side on which the sustaining discharge printed circuit boards are arranged.

In the eighth embodiment, the current is directly fed to the aluminum chassis 3100 and hence there exists a problem of unstable operation and radiated interference due to occurrence of a stray current. The conduction sheet 3614 is used to suppress the problem.

The sheet 3614 is one conduction sheet substantially equal in size to an aluminum chassis 3600. The sheet 3614 is made of copper and is 0.5 mm thick. To prevent direct contact of the sheet 3614 with the chassis 3600, the sheet 3614 is covered with an insulating substance, i.e., an insulation sheath 3617. The sheath 3617 is made of a flexible resin and is 0.2 mm thick. The sheath 3617 has a contour to completely cover the sheet 3614.

The sheet 3614 further extends from a portion brought into contact with the chassis 3600. The extended portions are a Y-side sheet-type lead 3615 and an X-side sheet-type lead 3616. An end portion of the lead 3615 is in contact with a ground terminal of ground-level wiring of a Y-side sustaining discharge printed circuit board 3604. Similarly, the lead 3616 is in contact with a ground terminal of ground-level wiring of an X-side sustaining discharge printed circuit board 3605. That is, the connection lines, namely, the leads 3615 and 3616 are used to connect the conduction sheet end portions to the end portions of the circuit boards. When the conduction sheet is absent, the connection lines may be directly connected to end portions of the aluminum chassis to flow the current from the circuit boards to the aluminum chassis.

The lead 3615 is near a Y-side flexible printed circuit board 3606. The lead 3615 is quite wide like the sheet 3614. Similarly, the lead 3616 is near an X-side flexible printed circuit board 3607. A current flowing through the circuit board 3616 is equal in phase to a current flowing through the lead 3615. These currents flow in mutually opposite directions. This applies also to currents flowing through the circuit board 3607 and the lead 3616. Lines of magnetic force generated by these currents cancel each other and hence inductance is quite small in this section. The ninth embodiment is remarkably advantageous in the reduction of inductance in this section.

Tenth Embodiment

Figure 18:
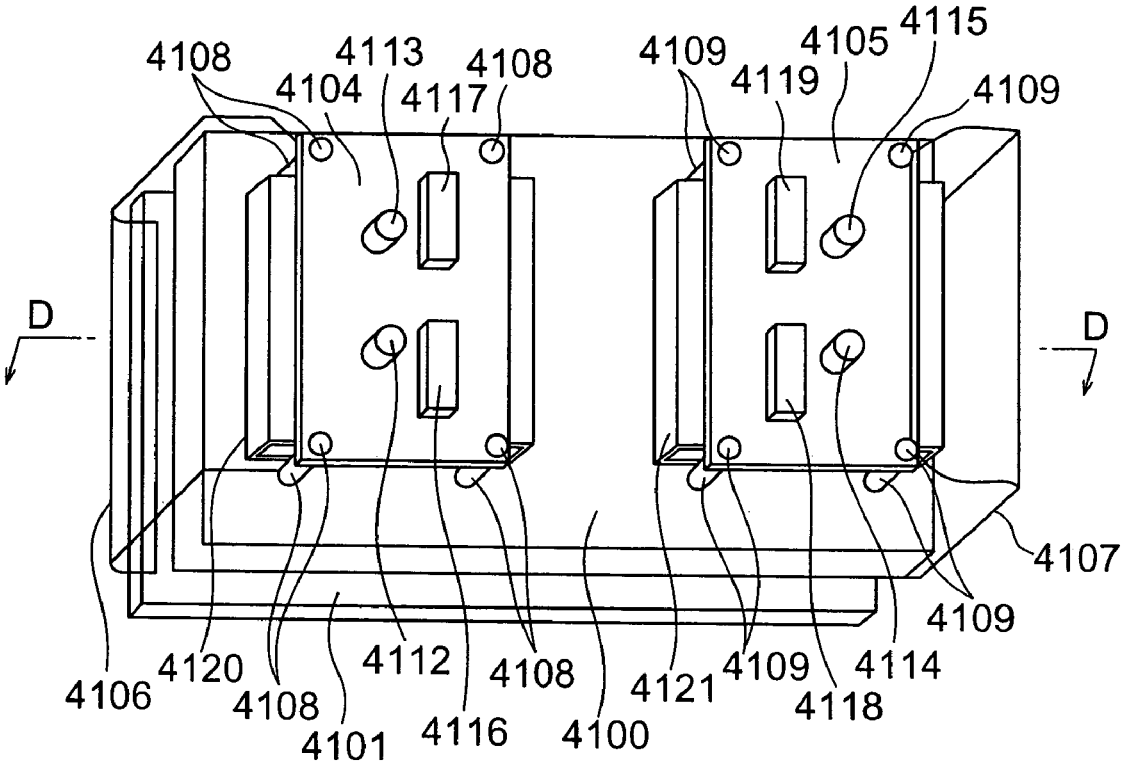
FIG. 18 is a perspective view showing an outline of a tenth embodiment of a plasma display apparatus according to the present invention.
Figure 19:
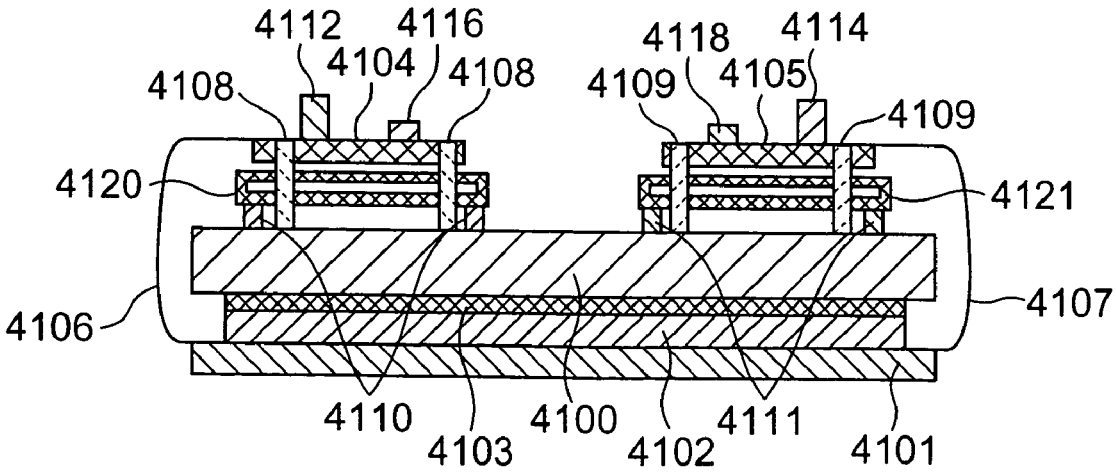
FIG. 19 is a cross-sectional view showing a cross section of the tenth embodiment shown in FIG. 18.

Referring to FIGS. 18 and 19, description will be given of a tenth embodiment of the present invention.

FIG. 18 shows the tenth embodiment of a plasma display apparatus according to the present invention, with a display surface of the apparatus facing the bottom, viewed from a position above the apparatus. FIG. 19 shows a cross section of FIG. 18 along line D-D.

In FIGS. 18 and 19, the plasma display panel includes a front panel 4101 which is a plate of glass on a side (display surface side) to radiate fluorescent light and a rear panel 4102 which is a plate of glass on a non-display surface side (rear side), the rear panel 4102 opposing the front panel 4101. A space between the two panels is filled with gas to cause plasma discharge. On a rear side (facing the rear panel 4102) of the front panel 4101, a plurality of pairs of sustaining discharge electrodes are formed. Each pair includes an X-electrode and a Y-electrode, not shown. On the rear side (an upper side in the diagram) of the front panel 4101, a rear panel 4102 (concealed in FIG. 18) and a two-side adhesive tape 4103 (also concealed in FIG. 18) are arranged. On the rear side of the tape 4103, an aluminum chassis 4100 (1.5 mm thick) is disposed. The tape 4103 is adhesive to fix the plasma display panel onto the aluminum chassis 4100. The plasma display apparatus including the panel and an outer case, not shown, is entirely fixed onto the chassis 4100.

Since the plasma display panel is large in size, the embodiment includes two sustaining discharge circuits to obtain uniform picture quality in the overall image displayed on the display panel. The rectangular display area of the panel is subdivided at a position on its short-edge side into two partitions along a line parallel to its long edges. The two circuits (associated circuits are indicated respectively by A and B following reference numerals) cover the respective partitions. On a Y-side sustaining discharge printed circuit board 4104 including a Y-electrode drive circuit, a Y-side power supply capacitor A 4112, a Y-side power supply capacitor B 4112, a Y-side semiconductor switch A 4116, and a Y-side semiconductor switch B 4117 are arranged. The circuit is further connected via a Y-side flexible printed circuit board 4106 to a Y-side electrode connecting terminal, not shown, of the front panel 4101. Similarly, on an X-side sustaining discharge printed circuit board 4105 including an X-electrode drive circuit, an X-side power supply capacitor A 4114, an X-side power supply capacitor B 4115, an X-side semiconductor switch A 4118, and an X-side semiconductor switch B 4119 are arranged. The circuit is further connected via an X-side flexible printed circuit board 4107 to an X-side electrode connecting terminal, not shown.

Description will be given of the path of the sustaining discharge current along its route. In the tenth embodiment, two current paths are formed by the respective drive circuits and cover the associated halves of the screen image. Since these circuits are substantially equal to each other and the currents are synchronized with each other, only one of the currents (of the drive circuit associated with a subscript A) will be described. It is assumed in the description that the operation is conducted in a phase in which the X-side power supply capacitor A 4114 is supplying the current.

The current from a high side terminal, not shown, of the capacitor A 4114 flows via the switch A 4118 and the circuit board 4105 to the circuit board 4107. The current changes from a concentrated flow into a dispersed flow at this point. Having conducted discharge in a space between the front and rear panels 4101 and 4102, the sustaining discharge current passes through the circuit board 4106 to the circuit board 4104. The current changes into a concentrated flow. The current is fed through ground level wiring, not shown, of the switch A 4116 and a Y-side electric connecting boss 4108 to the aluminum chassis 4100. The current flows through the chassis 4100 substantially in a parallel state and passes via an X-side electric connecting boss 4109 to the circuit board 4105. The current changes into a concentrated flow while passing through the boss 4109. The current flows via ground level wiring, not shown, of the circuit board 4105 to ground level wiring, not shown, of the capacitor A 4114 to thereby complete a loop.

Figure 20:
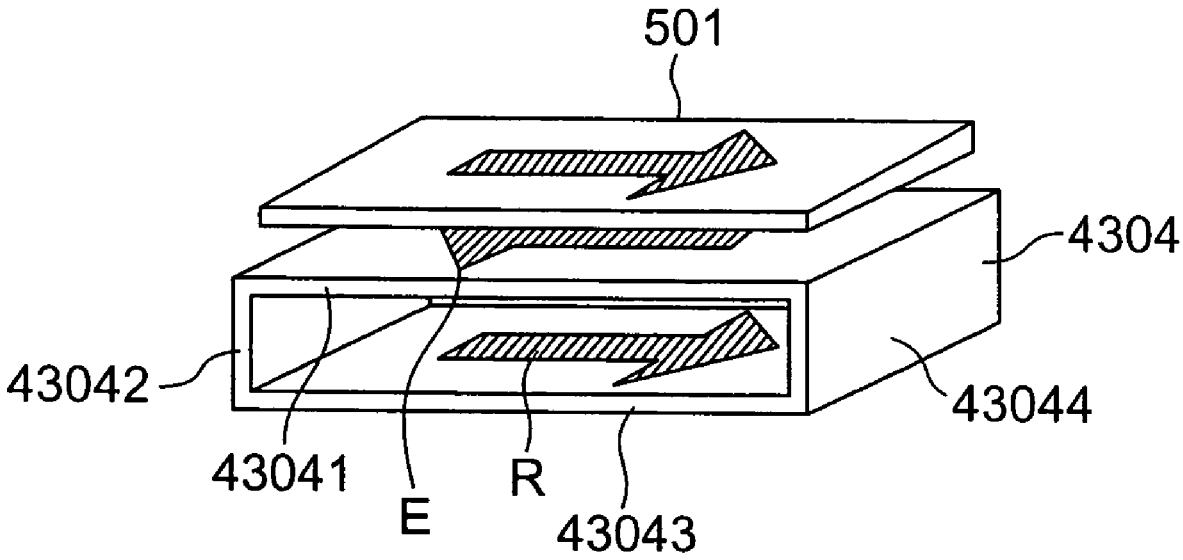
FIG. 20 is a diagram to explain a principle of the present invention.

Referring next to FIGS. 4 and 20, description will be given of a configuration for the reduction of inductance in the Y-side and X-side sustaining discharge circuit boards 4104 and 4105, that is, an operation principle of an Y-side rectangular pipe shaped conduction plate 4120 and an X-side rectangular pipe shaped conduction plate 4121. FIG. 4 schematically shows occurrence of an eddy current in the aluminum chassis in response to a drive pulse signal of the circuit board. FIG. 20 shows a principle of the present invention.

In FIG. 4, a current path plate 501 corresponds to a circuit obtained by simplifying part the wiring in the circuit boards 4104 and 4105. A neighbor conduction plate 501 corresponds to the aluminum chassis 4100. In a state in which the plate 501 is magnetically coupled with the plate 502, when a current changing with a lapse of time (indicated by an arrow in FIG. 4) flows through the plate 501, a current with a current phase equal to that of the current of the plate 501 flows in a direction opposite to that of the current of the plate 501 in an overlap portion between the plates 502 and 501, namely, in an eddy current inductive portion 503. Lines of magnetic force due to the current has a direction to cancel lines of magnetic force due to the current flowing on the plate 501. Therefore, inductance of the current path plate 501 is reduced. However, since the current occurring in the portion 503 is required to terminate within the plate 502, the current flows through a circumferential region of the portion 503 in a shape of "8". If the circumferential region is absent, the current appearing on the portion 503 is insufficient and hence the inductance is not fully reduced in the current path plate 501. For the magnetic coupling between the plates 501 and 502, it is required that the plates 501 and 502 are in the vicinity of each other.

However, the magnetic field in the current path plate 501, namely, in the circuit boards 4104 and 4105 is complex, and an eddy current due to the current disturbs the current flowing through the chassis. This leads to a fear that the inductance reduction effect by the mutual inductance between the opposite-directional currents flowing respectively through the plasma display panel (PDP) and the chassis is reduced.

Description will now be given of a fundamental configuration according to the present invention. FIG. 20 includes, in place of the neighbor conduction plate 502, a conduction member in a rectangular pipe shape. The conduction member includes a plate portion 43041 adjacent to the plate 501, a plate portion 43043 being apart from the plate 501 and facing the portion 43041, and side plate portions 43042 and 43044 connecting end portions of the plate portions 43041 and 43043. That is, the overall neighbor flat conduction plate is configured as a conduction plate 4304 having a shape of a rectangular pipe, the pipe having a cross section in a contour of an elongated rectangle. In the configuration, the portion 43041 is parallel to and sufficiently near to the plate 501. Contrarily, the portion 43043 is placed apart from the plate 501 by the side plate portions 43042 and 43044. That is, it is required in FIG. 20 that the magnetic flux due to the current of the current path plate 501 fully crosses the portion 43041 of the plate 4304 and less crosses the portion 43043.

This condition is satisfied as below. The portion 43041 is placed at a position possibly in the vicinity of the plate 501 to establish sufficient electromagnetic coupling with the plate 501. Contrarily, the portion 43043 is sufficiently apart from the plate 501 to establish sparse electromagnetic coupling with the plate 501.

For the eddy current caused by electromagnetic force E induced in the portion 43041 of the plate 4304, there is provided a return route R (for a loop current) including the portions 43042, 43043, and 43044. Therefore, a sufficiently large current flows through the portion 43041 of the plate 4304 in association with the electromagnetic force E to generate magnetic flux. This leads to a situation in which the magnetic flux remarkably cancels that generated by the current flowing through the current path plate 501. As a result, the inductance of the plate 501 is cancelled to be reduced.

In the configuration of FIG. 4, to return the induced eddy current, the neighbor conduction plate 502 has a peripheral portion extending toward outer sides beginning at a portion thereof overlapped with the current path plate 501. This occupies a large area and hence the plate 502 is larger by the area than that in the original state. In the configuration of FIG. 20, such a fear is absent since the eddy current returns through the conduction plate 4304. In addition, the overall area (the surface area of the rectangular pipe shaped member) of the current return path is less than that of FIG. 4. This is advantageous also in consideration of the production cost.

It is desirable that the size (area) of the plate portion 43041 of the plate 4304 is selected to achieve sufficient electromagnetic coupling with the plate 501 such that the area completely includes an area of a projected image of the plate 501 onto the portion 43041.

Returning to FIGS. 18 and 19, the Y-side and X-side plates 4120 and 4121 are members corresponding to the conduction plate 4304 described in conjunction with FIG. 20. The plates 4120 and 4121 are arranged in the neighborhood of and substantially parallel to rear surfaces (copper foil wiring surfaces) of the circuit boards 4104 and 4105. As already described for FIG. 20, when the sustaining discharge current flows in the circuit board 4105 from the switch A 4118 to the circuit board 4107, the magnetic flux crosses a portion of the plate 4121 near the circuit board 4105. As a result, electromotive force is induced by magnetic coupling in a direction opposite to the direction of the sustaining discharge current in the circuit board 4105. Thanks to the electromotive force, large eddy currents efficiently flow in a loop in the respective portions (i.e., wall surfaces of the pipe shaped structure) of the plate 4121, for example, as indicated by arrows in FIG. 20. The magnetic flux due to the eddy currents cancel that generated by the sustaining discharge current through the circuit board 4105, leading to inductance cancellation. This also applies to the Y side of the configuration.

In addition to the inductance reduction effect, the plates 4120 and 4121 have a second advantageous effect, i.e., a shield effect. This means that the magnetic fields appearing in the circuit boards 4104 and 4105 are complex and cause complex eddy currents in planar conductors in the neighborhood thereof. Although this brings about an effect to reduce inductance occurring in the circuit boards 4104 and 4105, the eddy currents disturb the current flowing into the chassis. If the plates 4120 and 4121 are absent, the eddy currents somewhat disturb the current flowing through the chassis. However, when the plates 4120 and 4121 are disposed at an intermediate point, the current disturbance is remarkably mitigated.

To efficiently attain the first and second effects of the Y-side and X-side plates 4120 and 4121, it is required to place the plates 4120 and 4121 at positions possibly near the Y-side and X-side printed circuit boards 4104 and 4105 and possibly apart from the chassis 4100. According to verification through experiments, it is favorable that the distance between upper surfaces of the plates 4120 and 4121 and a wiring layer in which ground level wiring is formed in the circuit boards

4104 and 4105 is less than that between lower surfaces of the plates 4120 and 4121 and the chassis 4100. At the same time, it is favorable that the distance between a surface of the front panel 4101 on a rear panel side thereof, which constitutes an X-electrode or a Y-electrode of the plasma display panel, and the chassis 4100 is less than that between the circuit boards 4104 and 4105 and the chassis 4100.

The plates 4120 and 4121 are fixed onto the aluminum chassis 4100. As fixing members, spacers made of an electrically insulating substance, i.e., a Y-side cut-off boss 4100 and an X-side cut-off boss 4100 are used.

The plates 4120 and 4121 are made of aluminum. Copper may also be used. Aluminum is used in consideration of the production cost. The plates 4120 and 4121 are 0.5 mm thick. Since the thickness (electric resistance) rarely affects inductance, the plates 4120 and 4121 may be thinner. The thickness is selected since the plates 4120 and 4121 having the thickness is relatively resistive to deformation and is easy to handle.

The distance between a lower surface of the circuit board 4104 and the plate 4120 and that between a lower surface of the circuit board 4105 and the plate 4121 are 6 mm. Since parts are inserted into the circuit boards, the above distance is obtained by reducing the distance to the maximum extent. The distance between lower surfaces of the plates 4120 and 4121 and an upper surface of the aluminum chassis 4100 is 10 mm. To regulate the sustaining discharge current flowing in the chassis 4100 (to obtain a parallel current flowing therethrough), it is effective to increase the distance. However, to reduce the depth of the plasma display apparatus, the distance is set to the value.

One of or both of an outer surface and an inner surface of the plates 4120 and 4121 may be covered with an electrically insulating substance. In this case, the conduction members, i.e., the plates 4120 and 4121 are a combination of a metal and a flexible insulating substance. By coating, for example, the outer surface with an insulating substance, the distance between the plates 4120 and 4121 and the circuit boards 4104 and 4105 can be much more reduced. By coating, for example, the inner surface, the thickness of the plates can be reduced. This makes it possible to reduce the depth of the plasma display apparatus.

The bosses 4108 and 4109 serve as fixing members to respectively fix the circuit boards 4104 and 4105 onto the chassis 4100 and are therefore arranged at four corners of the circuit boards.

Since the wiring pattern is relatively narrow in the circuit boards 4104 and 4105, inductance thereof is likely to become large. Therefore, to reduce the inductance, it is desirable to reduce the distance between the capacitors A 4112 and B 4113 and the boss 4108 and the distance between the capacitors A 4114 and B 4115 and the boss 4109.

In the above configuration, the circuit boards 4104 and 4105 include the associated plates 4120 and 4121. However, the present invention is not restricted by the embodiment. That is, by arranging the rectangular pipe shaped plate only for one of the sustaining discharge circuit boards, the effect can be naturally obtained although the effect is reduced.

11th Embodiment

Figure 21:
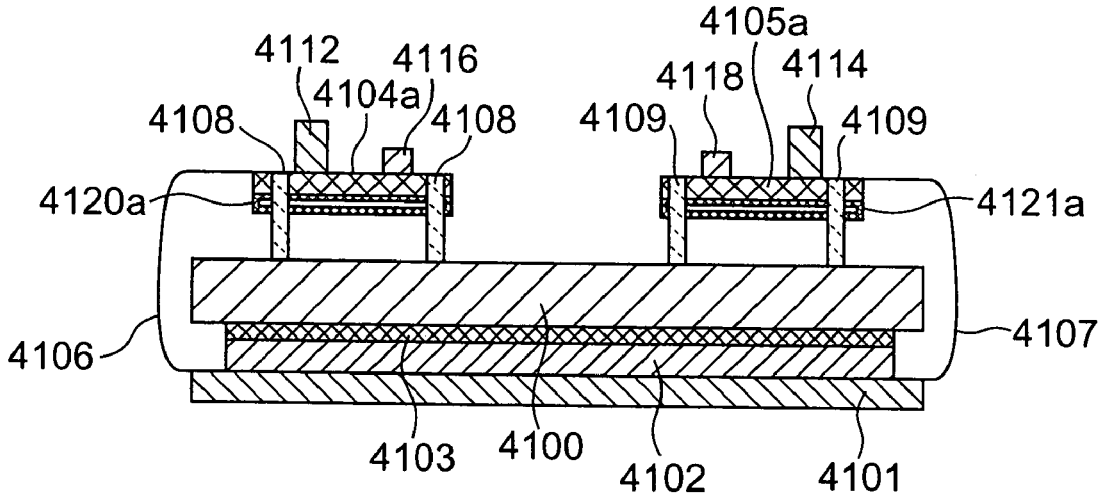
FIG. 21 is a perspective view showing an outline of an 11th embodiment of a plasma display apparatus according to the present invention.

Referring now to FIG. 21, description will be given of an 11th embodiment. In FIG. 21, the constituent components having the same functions as those of FIG. 19 are assigned with the same reference numerals, and description thereof will be avoided.

FIG. 21 shows a cross section of the 11 th embodiment of a plasma display apparatus according to the present invention. In the cross section, a lower side thereof corresponds to a display screen of a complete product of the apparatus.

In the embodiment, the distance between the rectangular pipe shaped conduction plate and the sustaining discharge printed circuit board is further reduced, and the plate includes two conduction layers of the circuit board and a plurality of via holes to establish connection therebetween.

In FIG. 21, a Y-side rectangular pipe shaped conduction layer 4120*a* (an X-side rectangular pipe shaped conduction layer 4121*a*) is constructed in rectangular pipe shaped conduction structure by establishing conduction between two conduction layers (insulated from each other by a circuit board substance) near the lower-most layer of a Y-side sustaining discharge printed circuit board 4104*a* (an X-side sustaining discharge printed circuit board 4105*a*) using a plurality of via holes. In FIG. 21, the layer is indicated by a thin elongated rectangle (drawn with a bold solid line) in the circuit board 410*a* (4105*a*). The two conduction layers correspond to the plates 43041 and 43043 of FIG. 20. The conduction portions made to be conductive by the via holes correspond to the plates 43042 and 43044 of FIG. 20.

As a result, the distance between surfaces respectively of the layers 4120*a* and 4104*a* is substantially equal to that between the wiring layers in the circuit board 4104*a*, i.e., about 0.5 mm. This similarly applies to the distance between surfaces respectively of the layers 4121*a* and 4105*a*.

The inductance reduction effect is less sensitive to the resistance value of the electric conductive members (the Y-side and X-side rectangular pipe shaped conduction layers 4120*a* and 4121*a* in this configuration) generating an eddy current. That is, the effect is kept unchanged by use of one layer (35 μm thick), without using the thick metallic plate of the tenth embodiment. Since the distance to the wiring layer is reduced, the effect is advantageously increased. As a result of verification through experiments, it is confirmed that when the distance between the two layers of the rectangular pipe shaped conduction layers is at least 1 mm, there can be obtained an inductance reduction effect more than that obtained using planar conduction layers under the same condition (with respect to areas thereof and distance therebetween).

However, the configuration has also a drawback. As described above, insert type components are mounted on the circuit boards 4104*a* and 4105*a*. Therefore, copper foil patterns (through holes) are provided at many positions in the circuit boards, the holes passing through the front and rear surfaces of the circuit boards. Through holes are also used for wiring between layers in the printed circuit boards. The through holes have various potential levels. This requires that the through holes other than those of ground-level wiring connected to the layers 4120*a* and 4121*a* are electrically insulated. As a result, there cannot be obtained a completely flat conduction film. It is not possible to obtain a complete conduction plate, and hence the effect is reduced.

For restrictions on the size in the planar direction, when a planar conduction layer is used, a sufficient space is required for an eddy current to complete a loop as in the neighbor conduction plate 502 of FIG. 4. In this connection, the conduction layer has a rectangular pipe shape in the 11th embodiment. Therefore, even the layer is equal in size to the circuit boards, the wall surfaces of the rectangular pipe shaped structure form a current path for the eddy current to return like the rectangular pipe shaped conduction plate 4304. This leads to an advantageous effect of a sufficient inductance reduction.

According to the 11th embodiment, by configuring the rectangular pipe shaped structure using the conduction layers in multilayer printed circuit boards, the distance between the conduction plate and the circuit boards is remarkably reduced. It is therefore possible to form a rectangular pipe shaped layer to obtain an inductance reduction effect using a smaller area. The advantageous effect can be sufficiently obtained using a small number of components.

12th Embodiment

Referring to FIGS. 4, 22, 23A to 23C, and 24, description will be given of a 12th embodiment of the present invention.

The 12th to 16th embodiments differ from those described above in that the present invention is applied to a plasma display panel of matrix electrode geometry. Description will now be given of a change in the flow of a sustaining discharge current in a circuit to drive the plasma display panel and modification associated with the change according to the present invention.

Figure 22:
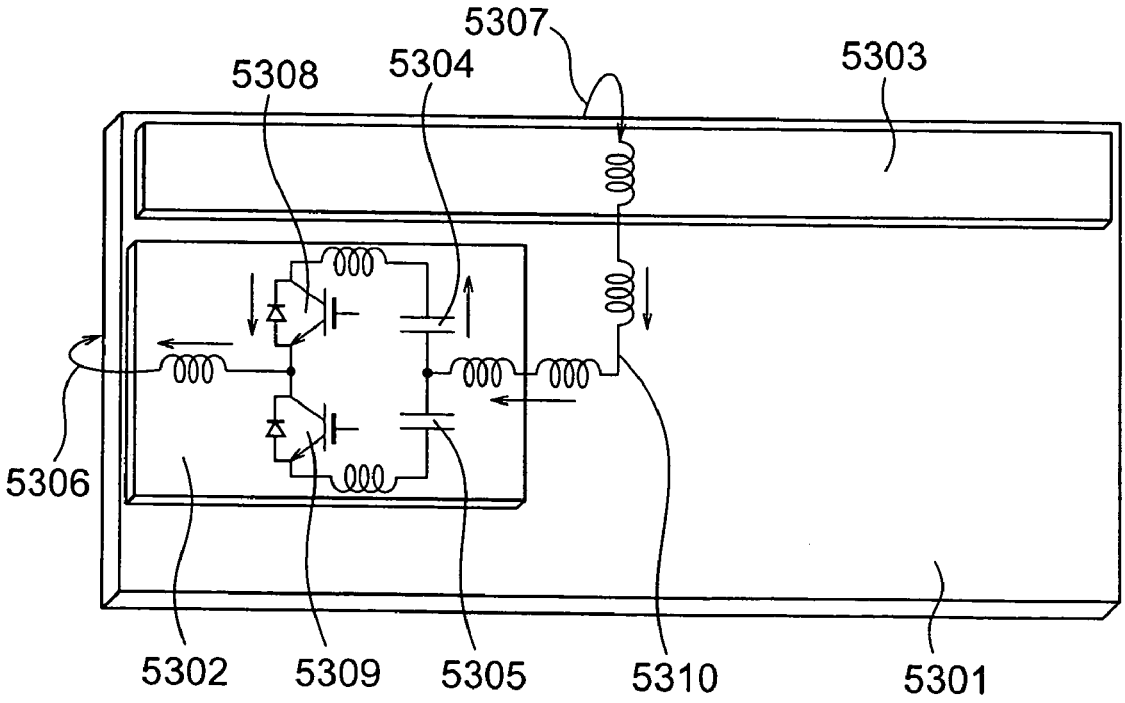
FIG. 22 is a diagram to explain a principle of the present invention.

FIG. 22 shows in a schematic diagram a plasma display apparatus of matrix electrode type associated with the 12th to 16th embodiments, specifically, a rear surface of a display surface (a front surface of a complete product of the apparatus). On a rear side (a front side of the product) of an aluminum chassis 5301, there actually exists a plasma display panel, not shown. In this type, in a space between electrodes disposed on two parallel glass plates, sustaining discharge is conducted for display. This means that the discharge is conducted in a direction perpendicular to the panel surface. Although it is ideal that the discharge electrodes are independently arranged for the respective display cells (pixels), the electrodes are required to be drawn up to an edge of the panel to supply a voltage and are connected an electrode extending along the overall length of the panel. In a panel (front panel) on the front side of the product, parallel electrodes arranged in parallel to each other extend in a horizontal direction (a longitudinal direction of the panel) up to an exposed region of an end portion of the panel. In the other panel (rear panel), parallel electrodes arranged in parallel to each other extend in a vertical direction (a direction of the short edges of the panel) up to an exposed region of an end portion of the panel. A voltage is externally applied to the electrodes. These electrodes covering the overall surface of the panel are collectively called "bus electrode". In summary, an aspect of installation of the sustaining discharge circuit of matrix electrode type is not associated with the supply of power to both end portions of the panel as in a coplanar type display, but is associated with the supply of power to combinations of (adjacent) end portions orthogonal to each other such as a left end portion and an upper end portion, a right end portion and a lower end portion, a left end portion and a lower end portion, and a right end portion and an upper end portion.

In the description, one bus electrode covers the entire length of the panel. There may also be considered structure for distributed power supply. In the structure of this type, for easy drive (for example, to secure gradation and brightness and to reduce unevenness on the screen), the panel is subdivided into two or four partitions. To supply a voltage to the partitions, there are used bus electrodes covering halves of the panel usually subdivided at a central portion into two partitions. In this situation, the voltage is applied from four edges (right, left, upper, and lower edges) at the maximum.

FIG. 22 shows an example of a configuration to supply a voltage from a left end portion and a right end portion, viewed from a rear side of the product. Two arrows are schematically indicate supply of a voltage to a display panel, not shown, by use of wiring for panel scan bus electrode 5306 (a connecting printed circuit board to electrically connect the printed circuit board to the front panel of the plasma display) and wiring for panel address bus electrode 5307 (a connecting printed circuit board to electrically connect the printed circuit board to the rear front panel of the plasma display).

Description will be briefly given of a reason for the orthogonal crossing of extending directions of the bus electrodes in the matrix electrode geometry, namely, the bus electrodes extend in the horizontal direction in the front panel and those extend in the perpendicular direction in the rear panel.

The plasma display has an aspect in which a process (of address discharge) to determine ON/OFF of each pixel and a process (of sustaining discharge) to light each cell are separately conducted.

The respective processes are conducted during mutually different periods of time. First, the address discharge is conducted "during an address period". Next, the sustaining discharge is conducted "during a sustaining discharge period". To secure a subsequent address discharge, a reset period is provided before an associated subsequent address period. These three processes are sequentially and repeatedly executed.

During an address period, it is required to identify each pixel. Therefore, the bus electrodes are arranged to orthogonally cross each other. A voltage to record ON/OFF is applied to a pixel at each intersection of the bus electrodes. The operation is in principle the same as the display operation of the liquid crystal display. The recording in each pixel is conducted for each line in the horizontal direction. Therefore, the bus electrodes (formed on the front panel) in the horizontal direction are called scan bus electrodes and those (formed on the rear panel) in the perpendicular direction are called address bus electrodes.

In the AC plasma display apparatus according to the present invention, the sustaining discharge is conducted by applying an AC voltage. Since the discharge results in a pulsated large current (a peak current thereof exceeds 100 ampere (A) per panel), it is required to possibly reduce impedance in the power supply. For this purpose, capacitors are used. In FIG. 22, a plus-side current supply capacitor 5304 is disposed to apply a voltage on the plus side and a minus-side current supply capacitor 5305 is used to apply a voltage on the minus side.

FIG. 22 shows a flow of a current when the plus-side voltage is applied. A current path is indicated by a bold line. A current from the capacitor 5304 on a scan printed circuit board 5302 flows via a plus-side semiconductor switch 5308 and wiring 5306 (specifically, a flexible printed circuit board) to the panel scan bus electrode. The wiring 5306 is connected to a connecting terminal, not shown, disposed in a left end portion of the front panel to establish connection with an external device. Thereafter, the current horizontally flows through the scan bus electrode, not shown, of the front panel and is fed to pixels to be lighted. The current then causes discharge and is delivered to the address bus electrode, not shown. The current further flows through the panel address bus electrode in a perpendicular direction to reach a connecting terminal, not shown, disposed in an upper end portion of the panel to establish connection with an external device. The terminal is connected to wiring 5307 to the panel address bus electrode. The current flows into an address printed circuit board 5303. In the circuit board 5303, a circuit is kept established during the sustaining discharge period such that the current flows into a ground layer, not shown, of the circuit board 5303. The current fed to the chassis 5301 directly connected to the ground layer passes through a chassis current path portion 5310 to return to the circuit board 5302. When the current returns to a connecting portion between the capacitors 5304 and 5305, that is, to a neutral point of the power source, the current loop is completed.

In a subsequent phase, the current flows in an opposite direction. In this regard, this phase is absent from FIG. 22. In the phase, the minus-side power supply capacitor 5305 serves as a power source. At a connecting portion between the capacitors 5304 and 5305, i.e., a neutral point of the power source, a current starts flowing and passes through the chassis current path portion 5310 to the circuit board 5303. The current flows into the wiring 5307 of the panel to pass through an address bus electrode and lights associated pixels. The current thereafter flows via a scan bus to the wiring 5306 of the panel scan bus electrode and passes through a minus-side semiconductor switch 5309 on the circuit board 5302 and returns to the minus-side terminal of the capacitor 5305 to thereby complete a current loop.

On the other hand, as indicated by coils in FIG. 22, each wiring has inductance. The inductance varies according to various factors such as length, width, and thickness of the wiring, a layout thereof, and presence or absence of wiring adjacent thereto. If the wiring length is kept unchanged, the wiring width, i.e., width of the dispersed current primarily determines the value of inductance. Of the sustaining discharge circuit described above, the wiring of the plasma display panel has inductance of about several hundred of nanohenry (nH; all wiring lines are arranged in parallel connection), which is the largest value among the portions having inductance. Excepting this portion, the chassis current path portion 5310, the scan printed circuit board 5302, and the address printed circuit board 5303 have a large value of inductance.

Like the wiring of the plasma display panel, the portion 5310 is sufficiently wide in comparison with the current flow length. Therefore, the absolute value of inductance is relatively small with respect to its magnitude. Since the flow direction of the current through the portion 5310 is opposite to that of the current flowing through the panel, the inductance cancellation effect takes place due to mutual inductance therebetween. It is therefore possible to reduce the total inductance of the panel and the portion 5310 down to quite a small value. The present invention is applied to the matrix electrode type and hence has an aspect that the current flow curves in the portion 5310. Therefore, the inductance cancellation effect is smaller when compared with the coplanar type. However, the current through the bus electrode of the panel flows in a horizontal direction in the front panel and in a direction vertical thereto in the rear panel, that is, the current flows respectively of the front and rear panel orthogonally intersect each other. This almost completely suppresses interference between magnetic fields generated by the respective currents. Therefore, the cancellation effect independently appears in the vertical and horizontal directions. Paying attention to this advantage, the present invention has been devised.

As above, the cancellation effect remarkably reduces the inductance of the chassis current path portion 5310. However, the wiring in the circuit boards 5302 and 5303 has restrictions in the layout thereof and has a large value of inductance in consideration of the short wiring length thereof. To overcome the difficulty, the present invention provides a solution to this problem using structure in which the cancellation effect is efficiently obtained due to mutual inductance between the panel and the portion 5310 and which additionally reduces the inductance of the wiring in the circuit boards 5302 and 5303.

Figure 23A:
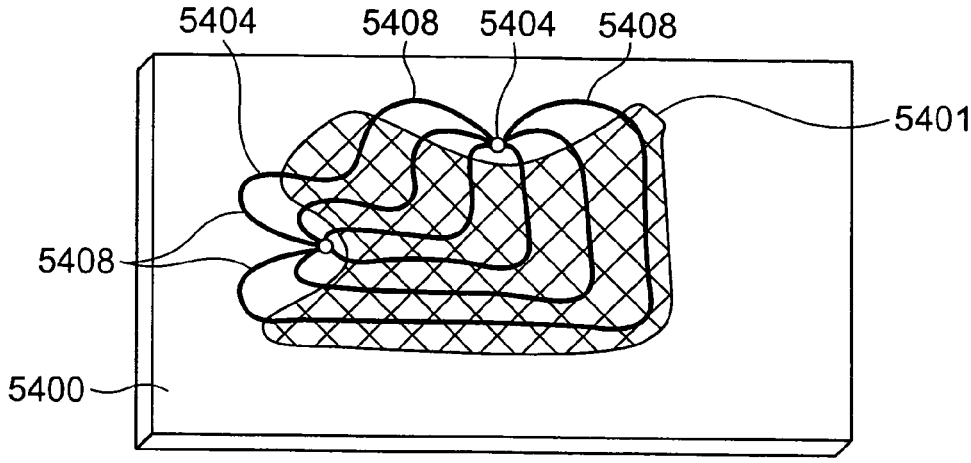
FIGS. 23A to 23C are diagrams to explain a principle of the present invention.
Figure 23B:
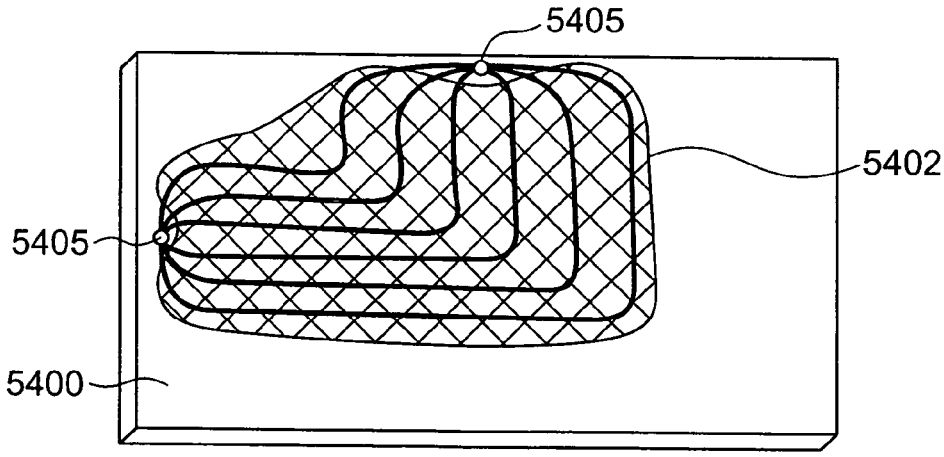
Figure 23C:
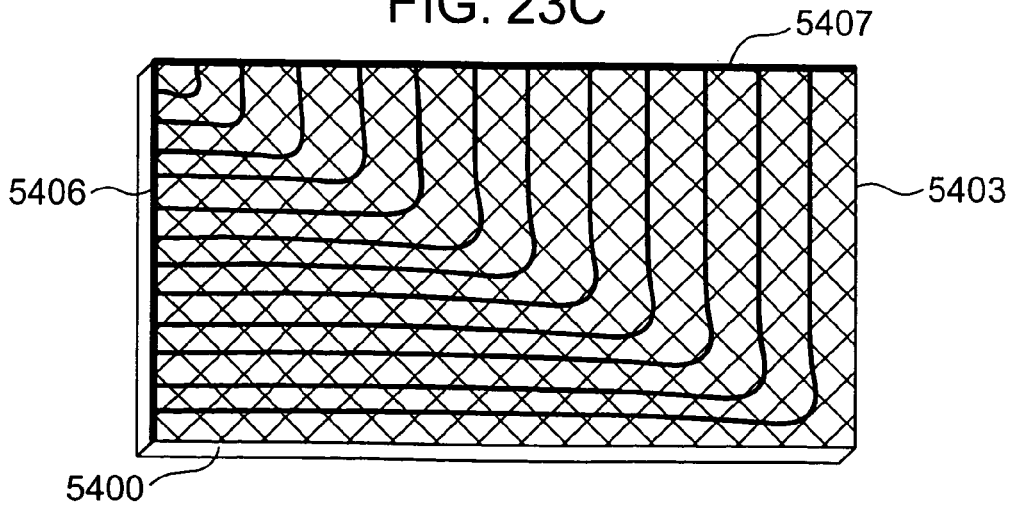

Referring now to FIGS. 23A to 23C, description will be given of a configuration to enhance the mutual inductance between the panel and the chassis current path portion. FIGS. 23A to 23C show the current distributions in the chassis 5400 when the ground level wiring of the scan printed circuit board and the address printed circuit board, not shown, is connected to the chassis 5400 at three different positions. In FIGS. 23A to 23C, curves indicate current flows. For simplification of the drawings, only the currents in the central portion of the chassis 5400 are shown, i.e., currents in the peripheral portions of the chassis 5400 are not shown in FIGS. 23A to 23C.

It can be seen from FIGS. 23A to 23C that the current flows are different from the ordinary current flows. That is, each current does not take a shortest course between power supply points or lines, but takes a detour. In addition, the current path curves with a relatively small curvature and flows along a substantially straight line. Specifically, at the curve of the current path (mainly, in the lower-right corner), the current path is expanded. These phenomena are caused by currents linearly flowing through the panel, not shown, in the respective directions orthogonal to each other. The magnetic field generated by the current flowing through the panel affects the current flowing through the chassis 5400. Therefore, the current through the chassis 5400 flows to align its direction to the direction of the current flowing through the panel. This considerably contributes to the inductance reduction. The expanded portion of the current in the curve of the current path indicates "overrun" due to a remarkable influence of the induction of the current on the chassis caused by the current flowing through the panel.

Thanks to the current flow in the chassis affected by the current flowing through the panel as above, the currents flowing respectively in the horizontal and vertical directions in the panel are respectively associated with the currents flowing respectively in the horizontal and vertical directions in the chassis. Each of the associated current pairs contributes to the inductance reduction in the pertinent direction. That is, in a portion in which the current flows in the horizontal direction through the chassis, the inductance reduction functions for the current flowing through the bus wiring of the panel in the horizontal direction. In a portion in which the current flows in the vertical direction through the chassis, the inductance reduction functions for the current flowing through the bus wiring of the panel in the vertical direction. Therefore, by maximizing the length and the width (i.e. an area) of the zone in which the currents flow through the chassis respectively in the horizontal and vertical directions, it is possible to maximize the inductance reduction effect.

Description will now be given of the difference between FIGS. 23A to 23C. First, description will be given of a case in which points to feed a current to the chassis 5400 are apart from an edge portion of the chassis (FIG. 23A). The current supply point 5404 is set to two positions, i.e., at a left position and an upper position. Although two or more current supply points are disposed at each position, only one current supply point is shown at each position in FIGS. 23A to 23C for simplicity. In the layout of FIG. 23A, there exist an area exceeding the left point 5404 and an area exceeding the upper point 5404. In the areas, part of the current does not directly flow to the opposing power supply point 5404, but flows in a reverse direction. That is, there exist reverse current portions 5408. Additionally, an area of a forward current portion 5401 hatched in FIG. 23A is less than an area of the remaining portion. As described above, due to an influence of the magnetic field generated by the current flowing through the panel, not shown, a current flows in the forward current portion 5401 in a direction substantially opposite to that of the current flowing through the panel. Therefore, inductance of this portion is considerably cancelled by the panel and the chassis 5400. However, in the remaining portion, the cancel effect is small. Particularly, the mutual inductance is positive in the reverse current portion 5407. That is, in this portion 5408, the mutual inductance is larger than the inductance of the portion 5408.

In FIG. 23B in which the points to supply a current to the chassis 5400 are less apart from an edge portion of the chassis 5400 than in FIG. 23A, there do not exist the positions such as the reverse current portions 5408 to remarkably increase inductance. Also, since a forward current portion 5402 of FIG. 23B is wider than the forward current portion 5401 of FIG. 23A, the inductance cancellation effect is increased. Resultantly, the total inductance of the panel and the chassis 5400 of FIG. 23B is reduced as compared with FIG. 23A.

Referring next to FIG. 23C, description will be given of a configuration to feed a current at an edge portion of the chassis 5400 using a scan-side power source line 5406 and an address-side power source line 5407. The lines 5406 and 5407 are not connected to each other. Unlike the two examples of FIGS. 23A and 23B, when the current is fed at points linearly disposed as shown in FIG. 23C, a forward current portion 5403 spreads over the entire surface of the chassis 5400. As a result, the mutual inductance between the sustaining discharge current flowing through the panel and that flowing through the chassis 5400 takes a minimum value (the absolute value is maximum since the value is negative). Therefore, the total inductance of the panel and the chassis 5400 is remarkably reduced. However, the currents flowing through the panel are orthogonal, the cancellation effect is absent from almost one half of the entire area, and hence the total inductance cannot approach zero. That is, the inductance can be reduced by establishing connection in a linear way respectively at the adjacent edges of the chassis.

Description has been given of the structure to reduce total inductance of the panel and the chassis using the mutual inductance. Referring now to FIG. 4, description will be given of structure to reduce inductance in the circuit board, which is difficult to control, in comparison with FIG. 22. The current path plate 501 of FIG. 4 corresponds to a simplified configuration of part of the wiring in the scan printed circuit board 5302 or the address printed circuit board 5303 of FIG. 22. The neighbor conduction plate 502 of FIG. 4 corresponds to the chassis 5301 of FIG. 22. In a state in which the plates 501 and 502 are magnetically coupled with each other, when a current which changes with respect to time (indicated by an arrow in FIG. 4) flows through the plate 501, a current appears in a portion of the plate 502 overlapped with the plate 501, i.e., an eddy current inducing section 503. The current has the same current phase as the current in the plate 501 and flows in a direction opposite to the current in the plate 501. Lines of magnetic force caused by the current in the section 503 have a direction to cancel lines of magnetic force caused by the current flowing on the plate 501. This consequently reduces the inductance of the plate 501. However, since it is required that the current occurring in the section 503 is terminated within the neighbor conduction plate 502, the current flows through an outer or circumferential region of the section 503 in a shape of "8". Thanks to the circumferential region, the current fully appears in the section 503 and the inductance of the plate 501 is sufficiently reduced. For the magnetic coupling between the plates 501 and 502, it is required that the distance therebetween is small.

The gist of the present invention resides in that the conduction plate is employed in the structure to obtain the two advantageous effects described above. The conduction plate is referred to as a current regulating plate in the description. The term "regulating" does not indicate "conversion of an alternating current into a direct current", but indicates to change the current flowing through the chassis into a parallel current.

Figure 24:
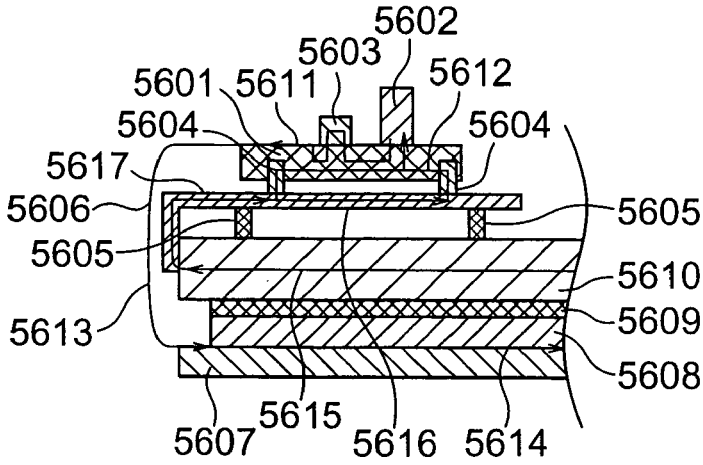
FIG. 24 is a perspective view showing an outline of a 12th embodiment of a plasma display apparatus according to the present invention.

FIG. 24 shows one half of a cross section of the embodiment of a plasma display apparatus along a line in a longitudinal direction of the apparatus. The cross section mainly shows structure associated with the scan printed circuit board. Since the structure also applies to the address printed circuit board and FIG. 24 becomes complex if the cross section of the address printed circuit board is also included, the address printed circuit board and its associated parts and devices are not shown. In FIG. 24, an arrow indicates a path and a direction of a sustaining discharge current at a particular point of time. A large arrow with a bold line indicates a path and a direction of a dispersed current (flowing in a planar shape). A small arrow with a narrow line indicates a path and a direction of a concentrated current (flowing in a narrow shape). According to characteristics of inductance, for an equal length of a current path, inductance is lower in a dispersed current path and is higher in a concentrated current path.

The sustaining discharge current from a plus-side electrode, not shown, of a plus-side power supply capacitor 5602 passes through a plus-side semiconductor switch 5603 and a wiring pattern of a scan printed circuit board 5601 to wiring 5606 of a panel scan bus electrode. Up to this point, the current flows through wiring in the printed circuit board in a concentrated flow path. Reference numeral 5611 indicates the current flowing through the scan printed circuit board to the panel. When the current enters the wiring to the panel scan bus electrode, the current disperses into a planar shape. Reference numeral 5613 indicates the current flowing through the wiring to the panel scan bus electrode. With the dispersed shape kept unchanged, the current passes through the scan bus electrode, not shown, disposed in a narrow space sandwiched by a front panel 5607 and a rear panel 5608, the electrode being disposed therein on the side of the front panel 5607. Reference numeral 5614 indicates the current flowing through the panel scan bus electrode. When the current reaches the pixels, the plasma display panel resultantly emits light. The current then passes through address bus wiring, not shown, disposed on the rear panel 5608 and wiring, not shown, to a panel address bus electrode. Up to this point, the current flows in a dispersed current path. When the current enters the address printed circuit board, the current flows in a concentrated shape. The current is fed from the address printed circuit board to an address-side current regulating plate, not shown. The current returns to a dispersed shape and flows to an end portion of the chassis 5601. With the dispersed shape kept unchanged, the current flows into the chassis 5601 from the end portion thereof. The current, dispersed in the overall width of the chassis 5601, takes a curve with substantially a right angle (FIG. 23C) and enters the cross section shown in FIG. 24. The current 5615 through the chassis flows up to a left end portion of thereof to enter a scan-side current regulating plat 5617. Incidentally, the plate 5617 is fixed by a scan circuit board side insulation spacer 5605. It is an aspect of the configuration that the current does not flow through the spacer 5606. That is, in any situation, the current flows up to an end portion of the chassis 5610. The current 5616, spread in the overall width of the chassis 5610, flows into the plate 5617 from an end portion thereof. This also applies to the address side although the configuration on the address side is not shown for simplicity of the diagram. The current flowing through the plate 5617 is in a dispersed shape. Up to this point, the dispersed shape is kept unchanged. The current passes through a scan circuit board side current path boss 5604 and flows through the chassis in the circuit board 5601 to the circuit board 5601. Reference numeral 5612 indicates the current returned to the circuit board 5601. In this portion, the current flows through a relatively narrow pattern. The current reaches the minus-side electrode, not shown, of the capacitor 5602 to thereby complete a current loop.

The scan side current regulating plate 5617 mainly has two functions. Although not shown, an address side current regulating plate having the same configuration as that of the plate 5617 also has the same functions.

First, the plate 5617 feeds the current in a concentrated state through the scan printed circuit board 5601 to the chassis 5610 in a dispersed state. At the connecting portion between the plate 5617 and the chassis 5610, the current is linearly dispersed so that the current 5615 through the chassis 5610 flows in a dispersed state and in a regulated state from an end portion to another end portion of the chassis 5610. As a result, the inductance cancellation effect of the current flowing through the panel span bus electrode and the current 5614 is increased to the maximum extent (FIG. 23C).

Second, the plate 5617 reduces inductance appearing in the wiring in the scan printed circuit board 5601. The current path plate 501 shown in FIG. 4 corresponds to a pattern in the circuit board 5601, and the neighbor conduction plate 502 corresponds to the plate 5617. That is, the inductance occurring in the wiring in the circuit board 5601 is reduced by an eddy current generated in the plate 5617. This effect is numerically less than that of the first function, but is important as a function to reduce inductance of wiring in the printed circuit board having many restrictions with respect to design of a pattern of the wiring.

Additionally, the plate 5617 has a third function, a shield effect, although its effect is smaller than those of the first and second functions. Magnetic fields generated in the circuit board 5601 are complicated and cause complex eddy currents on planar conductors existing in the vicinity of the circuit board 5601. This leads to an advantageous effect of reducing the inductance occurring in the circuit board 5601. However, the eddy currents disturb the current 5615 flowing through the chassis 5610. If the plate 5617 is absent, the current 5615 flowing through the chassis is somewhat disturbed by an eddy current. However, when the plate 5617 is disposed at an intermediate point, the disturbance of the current 5615 is remarkably reduced.

For efficient use of the first to third functions, the plate 5617 is desirably larger than the circuit board 5601. To sufficiently broaden the current particularly in the longitudinal direction (perpendicular to the current flow direction) of the circuit board, it is desirable that the plate 5617 is similar in size to the width of the chassis 5610 to the maximum extent.

To efficiently achieve the second and third functions, it is required that the plate 5617 is possibly in the vicinity of the circuit board 5601 and is apart from the chassis 5610. As a result of verification through simulations and experiments, it is confirmed that the distance between the plate 5617 and a wiring layer of the ground level wiring of the circuit board 5601 is desirably less than the distance between the plate 5617 and the chassis 5610. Also, the distance between plane on which the front panel 5607 faces the rear panel 614 and a panel side surface of the chassis 616 is desirably less than the distance between the plate 5617 and the chassis 5610.

13th Embodiment

Figure 25:
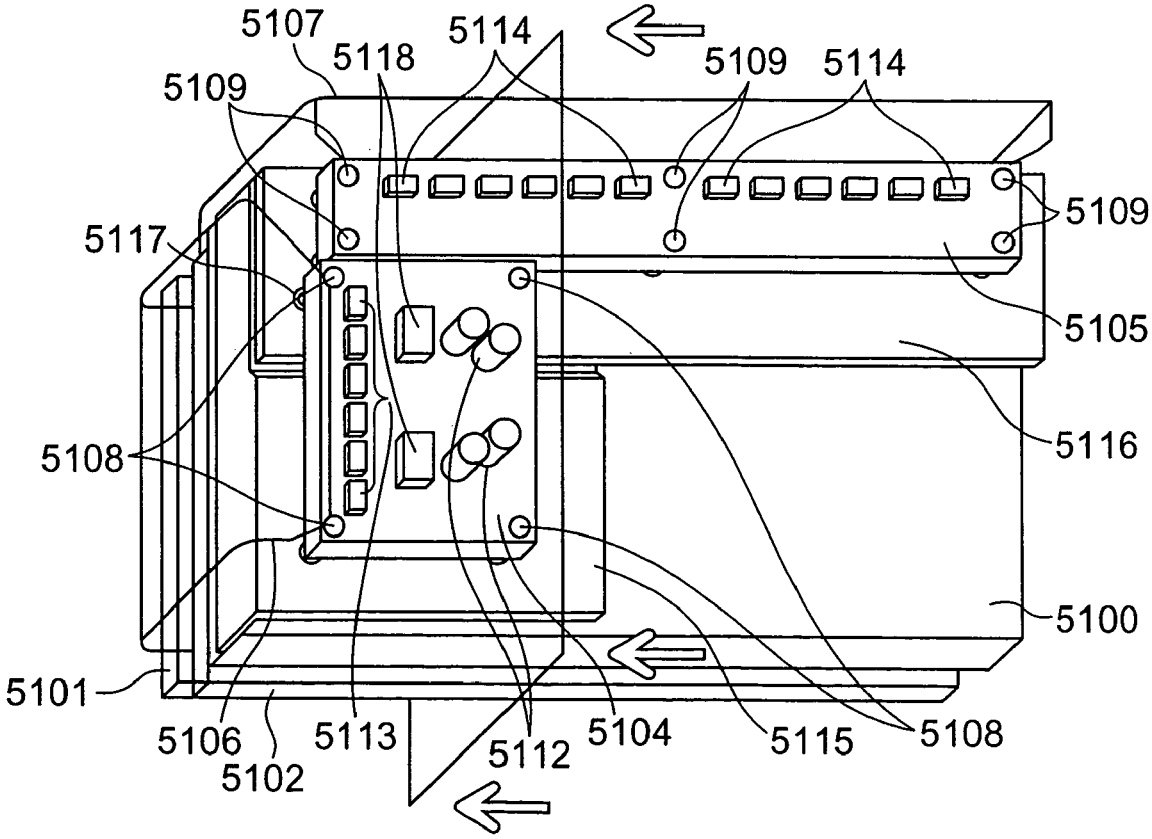
FIG. 25 is a perspective view showing an outline of a 13th embodiment of a plasma display apparatus according to the present invention.
Figure 26:
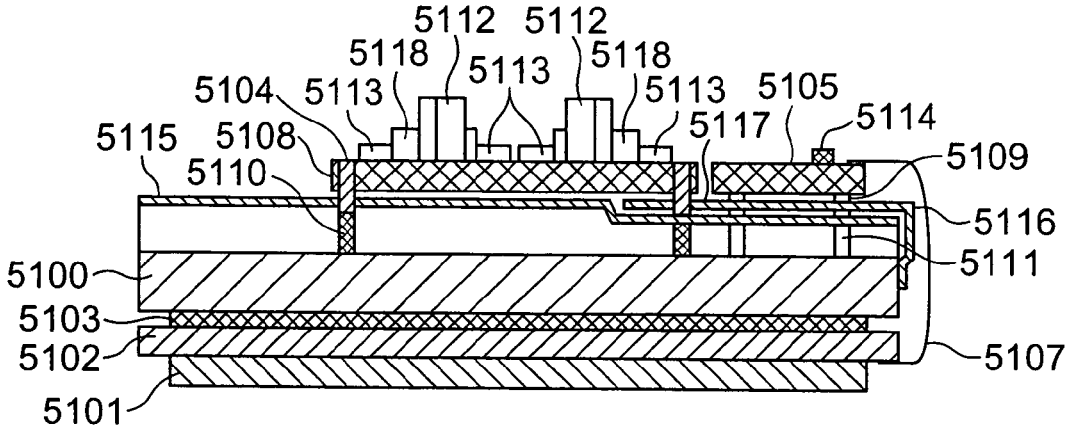
FIG. 26 is a cross-sectional view showing a cross section of the 13th embodiment shown in FIG. 25.

Referring now to FIGS. 25 and 26, description will be given of a 13th embodiment of the present invention.

FIG. 25 shows a perspective view of a plasma display apparatus in the 13th embodiment of the present invention with a display surface of the apparatus (a front surface of the complete product of the apparatus) facing the bottom side, viewed from a position above the apparatus. FIG. 26 shows a cross section of the apparatus taken along a short-edge direction thereof (a longitudinal direction). In FIG. 25, the cross-sectional view is shown using parallelograms with three arrows indicating the viewing direction.

The plasma display apparatus according to the 13th embodiment includes a plasma display panel including a front panel 5101 and a rear panel 5102; an aluminum chassis 5100, an outer case, not shown; and a scan side current regulating plate 5115, an address side current regulating plate 5116, a scan printed circuit board 5104, and an address printed circuit board 5105 fixed onto the chassis 5100.

The plasma display panel includes two plates of glass, i.e., the front panel 5101 and the rear panel 5102. On a rear surface (a surface opposing the rear panel 5102) of the front panel 5101, a scan bus electrode, not shown, is formed to set display/non-display (ON/OFF) to each pixel and to turn the pixel thereafter on/off. The scan bus electrode includes a large number of metallic fine lines formed in parallel to each other in a longitudinal direction of the front panel 5101. Connecting terminals to establish connection to an external device are disposed on a left end portion of the front panel 5101. On a front surface (a surface opposing the front panel 5101) of the rear panel 5102, an address bus electrode, not shown, is formed to set display/non-display (ON/OFF) to each pixel and to turn the pixel thereafter on/off. The address bus electrode includes a large number of metallic fine lines formed in parallel to each other in a short-edge direction of the rear panel 5102. Connecting terminals to establish connection to an external device are disposed on an upper end portion of the rear panel 5102. Gas is sealed in a space between the front and rear panels 5101 and 5102. In the space, plasma discharge takes place to display an image.

The plasma display panel is fixed onto the aluminum chassis 5100 (1.5 mm thick) using a two-side adhesive tape 5103. The chassis 5100 functions as a fixing member to fix other constituent components of the plasma display apparatus.

Since the plasma display apparatus of the 13th embodiment is a plasma display apparatus of matrix electrode geometry type, the same electrode is used during an address period to designate ON/OFF to each pixel and during a sustaining discharge period in which the operation is conducted in the overall screen at a time. Therefore, the sustaining discharge current is controlled between the scan printed circuit board 5104 and the address printed circuit board 5105. As compared with a plasma display apparatus of coplanar type in which two sustaining discharge wiring printed circuit boards arranged respectively on the right and left sides alternately supply the current, the circuit board 5104 supplies the current in the plasma display apparatus of matrix electrode geometry type. Therefore, during the sustaining discharge period, the circuit board 5105 has only a function to connect an address flexible printed circuit board 5107 to the aluminum chassis 5100.

On the circuit board 5104, a scan IC 5113 is mounted for use during an address period. During a sustaining discharge period, a current flows bypassing the scan IC 5113. During the sustaining discharge period, a sustaining discharge power supply capacitor 5112 is active and a sustaining discharge switch 5118 controls a current-flow (current direction and current flow timing adjustment). In this situation, a pair of sustaining discharge power supply capacitors 5112 operate as one unit. As can be seen from FIG. 22, only the circuit board 5104 controls the sustaining discharge currents in both directions. Therefore, a plus-side power supply capacitor 5304 and a minus-side power supply capacitor 5305 form a pair to operate as one unit.

On the other hand, an address IC 5114 is mounted on the circuit board 5105. During a sustaining discharge period, a current flows bypassing the address IC 5114. The circuit board 5105 does not include any constituent component to function during the sustaining discharge period. As above, the circuit board 5105 only connects the circuit board 5107 to the aluminum chassis 5100.

Description will be given of connection between the scan printed circuit board 5104 and the address printed circuit board 5105 and the chassis 5100. The circuit board 5104 is fixed onto a scan side current regulating plate 5115 using a scan electric connecting both 5108 (a second fixing member). The plate 5115 is fixed onto the chassis 5100 using a scan electric cut-off boss 5110 (a first fixing member). The plate 5115 is bent at an end portion to be electrically connected to the chassis 5100 on an end surface thereof. This also applies to the circuit board 5105. That is, the circuit board 5105 is fixed onto the address side current regulating plate 5116 using an address electric connecting boss 5109. The plate 5116 is fixed onto the chassis 5100 using an address electric cut-off boss 5111 (a third fixing member). The plate 5116 is bent at an end portion of the chassis 5100 to be electrically connected thereto. In a portion in which the plate 5115 overlaps with the plate 5116, steps are provided in the plate 5115 to separate the plate 5115 from the plate 5116. That is, two electric conductors, i.e., the plates 5115 and 5116 are connected to the chassis 5100 on surfaces of two orthogonal edges (long and short edges of the conductor) of the chassis 5100. The plates 5116 and 5116 are parallel to the associated edges of the chassis 5100.

In a portion of the plate 5116 through which the boss 5108 passes, an insulation pipe 5117 is engaged into the plate 5116 to prevent the current flowing from the plate 5104 into the plate 5116.

Description will now be given of the current path of the sustaining discharge current in the plasma display apparatus along its route.

First, description will be given of a phase in which the plus-side capacitor of the sustaining discharge power supply capacitors 5112 supplies the current. A current from a plus-side terminal, not shown, of the plus-side capacitor flows through the sustaining discharge switch 5118 and the circuit board 5104 to the flexible printed circuit board 5106. The current changes at this point from a concentrated flow into a dispersed flow. The current causes discharge in a space sandwiched between the front and rear panels 5101 and 5102 and then passes through the circuit board 5107 to the circuit board 5105. At this point, the current changes into a concentrated flow. The current passes through ground level wiring, not shown, and the boss 5109 to the plate 5116. The current changes into a dispersed flow. The current flows through a connecting portion (uniformly connected along the overall long-edge side of the aluminum chassis 5100) between the plate 5116 and the chassis 5100 to the chassis 5100 in a substantially uniformly dispersed state. The sustaining discharge current passing through the chassis 5100 in a dispersed flow vertically turns at an intermediate point and flows through a connecting portion (also uniformly connected along the overall short-edge side of the chassis 5100) between the plate 5115 and the chassis 5100 to the scan side current regulating plate 5115. The current changes into a concentrated flow while passing through the boss 5108 and then flows through ground level wiring in the circuit board 5104 to a ground terminal, not shown, of the plus-side capacitor of the capacitors 5112. The current thereby completes a current loop.

Description will next be given of a phase in which the minus-side capacitor of the capacitors 5112 supplies the current. Since operation in this phase is similar to that in the phase described above, description will be briefly given. A current from a plus-side terminal (not shown; ground level potential also for the minus-side terminal of the plus-side capacitor) passes through the boss 5108 to the scan side current regulating plate 5115. The current having dispersed in the plate 5115 flows through a connecting portion between the plate 5115 and the chassis 5100 to the chassis 5100. The current vertically turns in the chassis 5100 and flows through a connecting portion between the chassis 5100 and the plate 5116 to the plate 5116. After having passed through the plate 5116, the current flows through the boss 5109 to the circuit board 5105. Since ground level wiring is directly connected to the address flexible printed circuit board 5107 in the circuit board 5105, the current enters the circuit board 5107 and causes discharge in a space between the front and rear panels 5101 and 5102. Thereafter, the current passes through the circuit board 5106 to the circuit board 5104. The current flows through the switch 5118 in the circuit board 5104 to reach a minus-side terminal (not shown; negative potential) of the minus-side capacitor of the capacitors 5112. The current thereby completes a current loop.

Description will now be given of an aspect of the 13th embodiment, namely, the scan side current regulating plate 5115 and the address side current regulating plate 5116. The plate 5115 is a member to electrically connect the boss 5108 linked with ground level wiring of the circuit board 5104 to a left end portion of the chassis 5100. Similarly, the plate 5116 is a member to electrically connect the boss 5109 (a fourth fixing member) linked with ground level wiring of the circuit board 5105 to an upper end portion of the chassis 5100. The plates 5115 and 5116 are fixed onto the aluminum chassis 5100 using fixing members. The members are spacers made of an insulating resin, i.e., the scan electric cut-off boss 5110 and the address electric cut-off boss 5111. If the members are made of an electrically conductive substance, part of the sustaining discharge current flows through the members. This disturbs the current through the chassis 5100. In a connecting portion (an end portion) between the plates 5115 and 5116 and the chassis 5100, a two-side adhesive tape is fixed along the overall length to linearly pass the current through the overall width of the plates.

It is detected as a result of simulation that when the plates 5115 and 5116 are brought into contact with each other, part of the current to be fed to the chassis 5100 directly flows from the plate 5115 to the plate 5116 to cause disturbance in the current. Therefore, in the 13 th embodiment, in a portion in which the plates 5115 and 5116 overlap with each other, the plate 5115 is bent toward the side of the chassis 5100 to prevent connection between the plates 5115 and 5116. The plate 5115 is bent for the following reason. That is, to obtain the advantageous effect, it is required to possibly reduce the distance between the plates 5115 and 5116 and the circuit boards 5104 and 5105. Since higher priority is placed to the plate 5116 on the side of the plate 5105 having a smaller area and the portion to bend the plate 5115 is only a portion of the overlapped zone with the circuit board 5104, it has been considered that the eddy current effect is only slightly reduced. In the 13th embodiment, since the circuit boards 5104 and 5105 are substantially equal in height relative to the chassis 5100, the above configuration is adopted. However, if the height varies between the boards 5104 and 5105, the difference can be used to obtain a configuration in which the plates 5115 and 5116 are kept separated from each other.

Since the magnetic field due to the current flowing through the bus electrode of the panel has remarkable influence, even when the plates 5115 and 5116 completely unified into one unit, the main current does not directly flow between the plates 5115 and 5116, but flows through the chassis 5100. Therefore, separation of the plate 5115 from the plate 5116 is a devised configuration to increase the advantageous effect. However, this is not an indispensable item of the present invention.

The scan printed circuit board 5104 is a 4-layer printed circuit board and is 312 mm in a longitudinal direction (a vertical direction when a complete product of the apparatus is in use) and 240 mm in a horizontal direction (a horizontal direction when the complete product is in use). The scan side current regulating plate 5115 is 550 mm in a longitudinal direction and 300 mm in a horizontal direction. When viewed from a point just above the apparatus (from a front side in FIG. 25; from an upper side in FIG. 26; and from a rear side when the complete product is in use), the plate 5115 on the rear side of the circuit board 5104 extends from edges of the circuit board 5104. The address printed circuit board 5105 is also a 4-layer printed circuit board and is 75 mm in a longitudinal direction (a vertical direction when the complete product is in use) and 770 mm in a horizontal direction (a horizontal direction when the complete product is in use). The address side current regulating plate 5116 is 250 mm in a longitudinal direction and 850 mm in a horizontal direction. As in the case of the plate 5104, the plate 5116 on the rear side of the circuit board 5105 extends from edges of the circuit board 5105. The configuration is used for the following reason. That is, by securing the neighbor conduction plate 502 as described in conjunction with FIG. 4, the return of the eddy current is facilitated. The dimensions and the layout described above are determined to sufficiently increase the eddy currents occurring in the plates 5115 and 5116 due to the magnetic fields caused by the sustaining discharge currents in the respective circuit boards. Additionally, the dimensions in the direction vertical to that of the current flow (a longitudinal direction for the scanning and a vertical direction for the addressing) are determined for, in addition to the above purpose, a purpose to spread the current in the overall width to the maximum extent. That is, the longitudinal size and the vertical size respectively of the scan and address side current regulating plates are set to be possibly similar to the longitudinal dimension 575 mm and the vertical dimension 930 mm of the chassis 5100.

The plates 5115 and 5116 are made of aluminum. Although copper may also be used, aluminum is favorable in consideration of the production cost. The plates are 0.5 mm thick. Since inductance is rarely influenced by the thickness (electric resistance), the plates may be thinner. This thickness is determined because the plates of the thickness are not easily deformed, but are easy to handle.

The distance between a lower surface of the circuit board 5104 and an upper surface of the plate 5115 and that between a lower surface of the circuit board 5105 and an upper surface of the plate 5116 are 6 mm. Since it is required to insert components or parts in the circuit boards 5104 and 5105, the distance is possibly reduced to a limit in consideration of such components or parts. The distance between lower surfaces respectively of the plates 5115 and 5116 and an upper surface of the aluminum chassis 5100 is 10 mm. For efficient regulation of the sustaining discharge current flowing through the chassis 5100, it is effective to increase the distance. However, the value of 10 mm is determined to possibly reduce the depth of the overall complete product.

The bosses 5108 and 5110 are used to fix the circuit board 5104 onto the chassis 5100 and the bosses 5109 and 5105 are used to fix the circuit board 5105 onto the chassis 5100. The bosses are arranged at four corners of the circuit board 5104 and at four corners and at two central positions of the circuit board 5105 having an elongated rectangular shape. The bosses 5108 and 5110 and the scan bosses 5109 and 5111 are linked with each other using equal axles. This secures the fixing of the circuit boards 5104 and 5105 onto the chassis 5100. On the circuit boards 5104 and 5105, the wiring is implemented using a pattern having relatively small width, and hence inductance thereof is likely to increase. To reduce the inductance, it is desirable to reduce the distance between the capacitor 5112 and the boss 5108.

In a variation of the 13th embodiment, to prevent contact between the scan side current regulating plate and the address side current regulating plate, the distance between the scan side current regulating plate and the chassis may differ from that between the address side current regulating plate and the chassis. As above, the distance between the scan printed circuit board and the associated current regulating plate and that between the address side current regulating plate and the associated current regulating plate are desirably as small as possible. Therefore, when the difference in height of the current regulating plates relative to the chassis is selected to be substantially equal to that of the respective circuit boards relative to the chassis, either one of the current regulating plates is brought into contact with the circuit board of the other current regulating plate. To avoid the contact, the current regulating plate apart from the chassis is used as a current regulating plate including an insulation layer as shown in a 15th embodiment and is inserted into the printed circuit board corresponding to the current regulating plate near the chassis. It is favorable in the configuration that the insulation layer is formed on both main surfaces of the current regulating plate.

It is also to use structure shown in a 16th embodiment to similarly provide the difference in distance between the current regulating plates relative to the chassis. The structure uses a copper foil layer of a printed circuit board.

14th Embodiment

Description will now be given of a 14th embodiment of the present invention by referring to FIGS. 27 and 28.

Figure 27:
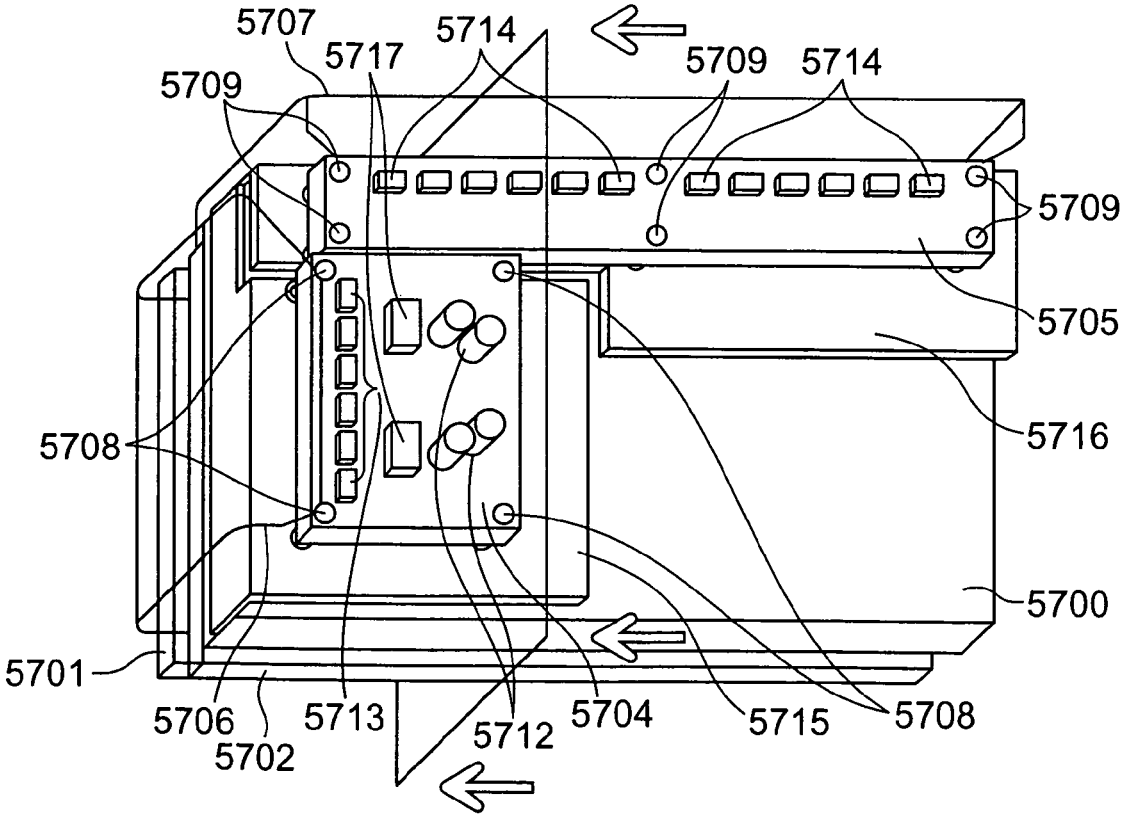
FIG. 27 is a perspective view showing an outline of a 14th embodiment of a plasma display apparatus according to the present invention.
Figure 28:
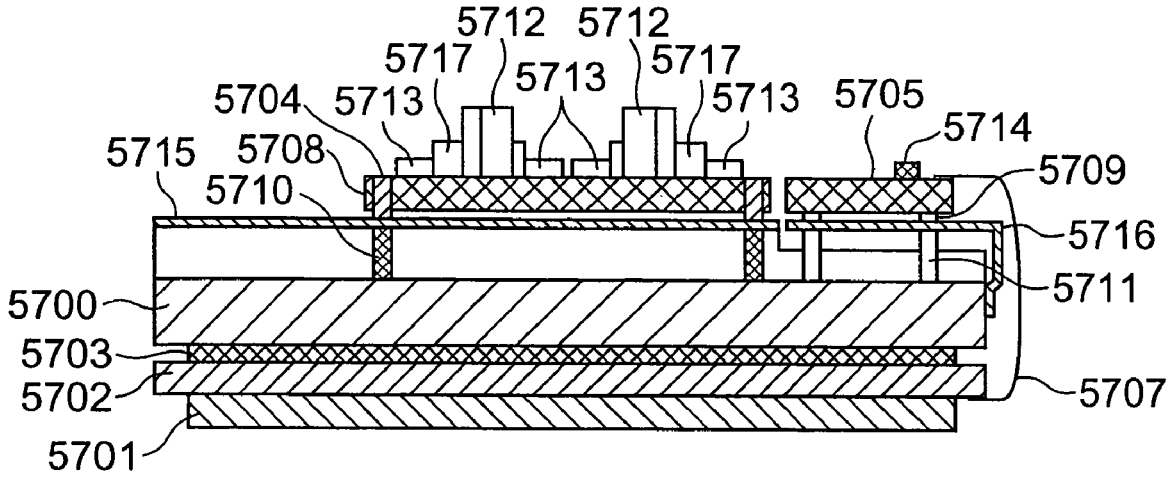
FIG. 28 is a cross-sectional view showing a cross section of the 14th embodiment shown in FIG. 27.

FIG. 27 shows a perspective view showing a 14th embodiment of a plasma display apparatus with a display surface (a front surface of a complete product of the apparatus) facing the bottom side, viewed from a point above the apparatus. FIG. 28 is a cross section taken along a line in a short-edge direction (a longitudinal direction) of the apparatus. The cross-sectional view is shown using parallelograms with three arrows indicating the viewing direction.

The plasma display apparatus of the 14th embodiment is similar to that of the 13th embodiment, but differs therefrom as below.

The 14th embodiment is different from the 13th embodiment in the configuration of a scan side current regulating plate 5715 and an address side current regulating plate 5716. That is, in the 13th embodiment, the scan and address side current regulating plates overlap with each other and it is devised in the configuration to electrically separate the plates from each other. In the configuration of the 14th embodiment, the plates 5715 and 5716 do not overlap with each other. Each of the plates 5715 and 5716 has a notch to avoid the overlapping therebetween. Specifically, the two conductors, i.e., the plates 5715 and 5716 are electrically separated from each other and are substantially equally apart from the conductor, i.e., the chassis. Even with the notch, the plate 5716 is not short in the portion for connection with the chassis 5700 and extends along almost the overall length in the longitudinal direction. Therefore, no particular idea is required to obtain the configuration. However, in the plate 5715, the portion overlapped with the plate 5716 extends up to a position near an end portion of the chassis 5700. That is, by use of a simple rectangular shape, it is not possible to establish the connection along the overall length of one edge of the chassis 5700. In this situation, to establish the connection along the overall length of one edge of the chassis 5700, steps are disposed in the notch excepting the connecting portion. Reference is to be made also to the cross-sectional view shown in FIG. 28.

The 14th embodiment is more advantageous than the 13th embodiment in that the plates 5715 and 5716 can be disposed at positions possibly near the circuit boards 5704 and 5705. This is because of absence of the restriction in the direction of height relative to the chassis 5700. Contrarily, the 14th embodiment has a drawback that efficiency of eddy current generation is reduced due to the small area of the current regulating plate. This means that the 14th embodiment has an advantage and a drawback when compared with the 13th embodiment. To determine adoption of the 14th embodiment, it is required to compare the advantage and the drawback between the 14th embodiment and the 13th embodiment.

15th Embodiment

Figure 29:
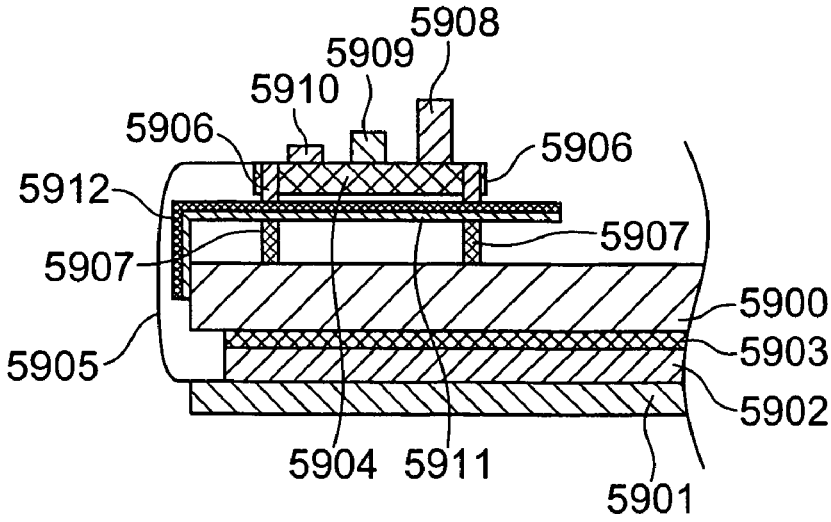
FIG. 29 is a cross-sectional view showing a cross section of a 15th embodiment of a plasma display apparatus according to the present invention.

Referring now to FIG. 29, description will be given of a 15th embodiment of the present invention.

FIG. 29 shows substantially a half portion of a cross section of the 15th embodiment of a plasma display apparatus according to the present invention. The lower side corresponds to a display surface (a front surface) of the apparatus. FIG. 29 shows a left-half portion of the cross section taken along a longitudinal direction of the apparatus. That is, FIG. 29 shows structure around a scan printed circuit board. Since the structure also applies to an address printed circuit board and FIG. 29 becomes complex if the cross section of the address printed circuit board is also included, the address printed circuit board and its associated parts and devices are not shown.

The 14th embodiment has an aspect that a scan side current regulating plate insulation layer 5912 is disposed on a scan side current regulating plate 5911. Using this structure, the plate 5911 can be placed at a position further in the vicinity of a scan printed circuit board 5904. As above, the smaller the distance between the current regulating plate and the printed circuit boards associated with the sustaining discharge, i.e., the scan printed circuit board and the address printed circuit board is, the less the inductance in the printed circuit boards associated with the sustaining discharge is. However, tips of constituent components on the circuit board extend above the circuit boards. Although not completely impossible, it is actually not possible to reduce the distance to a value equal to or less than about 5 mm.

In this connection, the plate 5911 of the 14th embodiment has a surface facing the circuit board 5904, the surface being coated with a film of an insulating substance. That is, there is disposed an electric insulation layer, i.e., a scan side current regulating plate insulation layer 5912.

The substance of the layer 5912 is an ordinary organic resin. Although the layer 5912 is not made of any particular substance, it is thick, i.e., is 0.5 mm thick. Therefore, even when tips of constituent components on the circuit board 5904 stick in the layer 5912, the insulation is kept unchanged. As a result, the distance between the surfaces respectively of the plate 5911 and the circuit board 5904 can be reduced to a considerably small value, i.e., about 1 mm.

By applying the one-side insulated current regulating plate of the 14th embodiment to the overlapped portion between the scan side and address side current regulating plates, the plates can be closely fixed onto each other. Therefore, the distance between the circuit boards associated with the sustaining discharge, i.e., the scan and address printed circuit boards and the current regulating plates can be reduced. In the 13th embodiment, the idea is applied to the scan side current regulating plate 5115. The advantageous effect is achieved in the portion in which the plate 5115 is below the plate 5116 and which is below the circuit board 5104. This means that the plate 5115 can be arranged at a higher position (less apart from the circuit board 5104).

16th Embodiment

Figure 30:
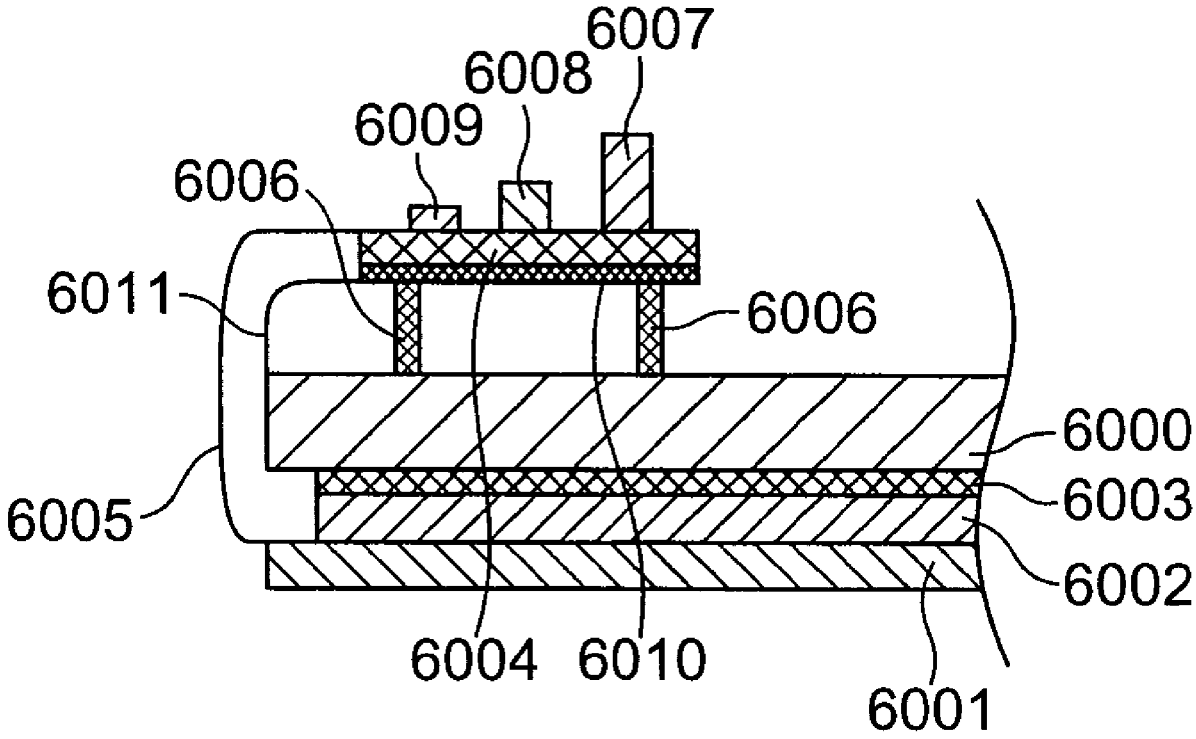
FIG. 30 is a cross-sectional view showing a cross section of a 16th embodiment of a plasma display apparatus according to the present invention.

Referring now to FIG. 30, description will be given of a 16th embodiment of the present invention.

FIG. 29 shows substantially a half portion of a cross section of the 15th embodiment of a plasma display apparatus according to the present invention. The lower side corresponds to a display surface (a front surface) of the apparatus. FIG. 29 shows a left-half portion of the cross section taken along a longitudinal direction of the apparatus. That is, FIG. 29 shows structure around a scan printed circuit board. Since the structure also applies to an address printed circuit board and FIG. 29 becomes complex if the cross section of the address printed circuit board is also included, the address printed circuit board and its associated parts and devices are not shown.

The 16th embodiment is almost the same as the 15th embodiment and has an aspect that the distance between each current regulating plate and the associated sustaining discharge printed circuit board is further reduced such that the current regulating plate is a conductor layer of the circuit board.

The distance between surfaces of a scan side current regulating plate 6010 and a scan side printed circuit board 6004 is substantially equal to the distance between the wiring layers in the circuit board 6004, i.e., about 0.5 mm. In this structure, it is not possible to establish connection to an aluminum chassis 6000. As a connecting member, a scan side current regulating flexible printed circuit board 6011 is connected thereto using a connector similar to that used for a scan flexible printed circuit board 6005. Although the members may be simply metallic plates or metallic foil, a flexible printed circuit board is used for good structural matching with connectors on the circuit board. However, the circuit board is a simple circuit board not including any particular pattern.

The inductance reduction effect is less sensitive to the resistance value of the electric conductive member (the scan side current regulating layer 6010 in the configuration) generating an eddy current. That is, it is not necessarily required to use a thick metallic plate like that used in the 13th embodiment. The inductance reduction effect can be kept unchanged by use of one layer (35 μm thick) of the printed circuit board. Contrarily, since the distance to the wiring layer is reduced, the inductance reduction effect is advantageously increased. However, as described above, constituent components or devices are mounted on the scan printed circuit board 6004. Therefore, copper foil patterns (through holes) are provided in the circuit board, the holes passing through the front and rear surfaces of the circuit board. Through holes are also used for wiring between layers in the printed circuit board. The through holes have various potential levels. It is required that the through holes other than those of ground-level wiring connected to the layer 6010 are electrically insulated. As a result, there cannot be obtained a completely flat conduction film. It is not possible to obtain a complete conductive plate, and hence the effect is reduced.

There also exists a restriction on the size in the planar direction. In the 13th to 15th embodiments, the current regulating plate is slightly larger in size than the sustaining discharge printed circuit board. There hence exists a sufficient space for an eddy current to draw a loop as in the neighbor conduction plate 502 of FIG. 4. In the 16th embodiment, the current regulating plate is substantially equal in size to the printed circuit board, and the configuration is disadvantageous in consideration of formation of the loop of the eddy current. However, it does not occur in actual wiring that the pattern through which the sustaining discharge current flows through the printed circuit board has a contour almost equal to that of the printed circuit board. That is, a considerably large space remains in a periphery of the printed circuit board in many cases. Therefore, in the 16th embodiment, the effect of remarkable reduction of the distance between the current regulating plate and the printed circuit board more remarkably contributes to the advantage of the present invention, and the inductance reduction effect is considerably developed. Naturally, the effect can be more enhanced by appropriately increasing the scan printed circuit board 6004 in size.

By using one layer of a multilayer printed circuit board, even in the overlapped portion between the scan side and address side current regulating plates, the plates can be closely fixed onto each other. This also advantageously reduces the distance to the wiring layer in the circuit board.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A plasma display apparatus, comprising:

a plasma display panel on which electrodes are formed;

an electric conductive conductor for fixing the plasma display panel;

a first circuit board and a second circuit board fixed onto the conductor using a plurality of fixing members;

a first electric power supply and a second electric power supply disposed respectively for the first and second circuit boards;

a first conductive plate and a second conductive plate disposed respectively between the conductor and the first and second circuit boards; and a first connecting circuit board and a second connecting circuit board connected respectively between an end portion of the first circuit board and a first end portion of the plasma display panel and an end portion of the second circuit board and a second end portion of the plasma display panel, wherein in the first circuit board, a current from the first circuit board to the first connecting circuit board and a current from the conductor to the first circuit board flow from/to the same side of the first circuit board.

2. A plasma display apparatus according to claim 1, wherein the current supplied from the first circuit board flows through one of the pair of connecting circuit boards, the plasma display, other one of the pair of connecting circuit boards, and the second circuit board in this order, the current further flowing through the fixing members connected to the second circuit board, the conductor, the fixing members connected to the first circuit board, and the first circuit board.

3. A plasma display apparatus, according to claim 1, wherein a direction of a current flowing in the plasma display panel is opposite to a direction of a current flowing in the conductor.

4. A plasma display apparatus, according to claim 1, wherein:

each of the first and second circuit boards includes a capacitor as the electric power supply and a semiconductor switch to control supply of a current, and the capacitor is disposed at a position less apart from an end portion of the plasma display panel as compared with the semiconductor switch.

5. A plasma display apparatus, according to claim 1, wherein:

each of the first and second circuit boards includes a capacitor as the electric power supply and a semiconductor switch to control supply of a current, and distance between a position at which the capacitor is connected to the associated circuit board and a position at which the electric conductive conductor is connected to the associated circuit board is equal to or less than one half of length of a short edge of the associated circuit board.

6. A plasma display apparatus, according to claim 1, further comprising:

an electric conductive sheet disposed on a surface of the conductor opposite to a surface thereof on which the plasma display panel is disposed; and a pair of connecting lines for connecting end portions of the sheet to end portions of the first and second circuit boards.

7. A plasma display apparatus, according to claim 1, further comprising a pair of electric conductive plates disposed between the conductor and the first and second circuit boards, wherein currents supplied respectively from the first and second circuit boards flow respectively via the associated electric conductive plates to the conductor.

8. A plasma display apparatus, according to claim 7, wherein each of the electric conductive plates has a shape of a rectangular pipe.

9. A plasma display apparatus, according to claim 7, wherein the electric conductive plates are connected respectively to side surfaces of the conductor, the side surfaces respectively facing the associated electric conductive plates.

10. A plasma display apparatus, according to claim 9, wherein each of the electric conductive plates is connected an upper surface or a lower surface of the conductor.

11. A plasma display apparatus, according to claim 7, wherein the electric conductive plates are formed in a unit together with the first and second circuit boards.

12. A plasma display apparatus, according to claim 11, wherein the electric conductive plates are disposed to be brought into contact with the first and second circuit boards.

13. A plasma display apparatus, according to claim 7, wherein each of the electric conductive plates includes a metallic plate and a flexible insulator fixed onto each other.

14. A plasma display apparatus, according to claim 7, further including an insulation layer between the electric conductive plates and the first and second circuit boards.

15. A plasma display apparatus, according to claim 7, wherein the electric conductive plates are connected to the conductor at a plurality of positions thereof, the positions being disposed substantially in one line.

16. A plasma display apparatus, according to claim 7, wherein distance between surfaces of the electric conductive plates and a surface of the conductor is more than distance between the surfaces of the electric conductive plates and surfaces of the first and second circuit boards.

17. A plasma display apparatus, according to claim 7, wherein the distance between surfaces of the electric conductive plates and a surface of the conductor is more than distance between the surface of the conductor and a surface of the plasma display panel.

18. A plasma display apparatus, according to claim 7, wherein a perpendicular projected surface of each of the electric conductive plates onto the conductor covers a perpendicular projected surface of an associated one of the first and second circuit boards onto the conductor.

19. A plasma display apparatus, comprising:

a plasma display panel on which electrodes are formed;

an electric conductive conductor for fixing the plasma display panel;

two electric conductive plates including first and second electric conductive plates disposed on a surface of the conductor opposing a surface on which the plasma display panel is disposed, the electric conductive plates being electrically connected to an end portion of the conductor;

two circuit boards including a first circuit board and a second circuit board electrically connected respectively to the electric conductive plates, the first and second circuit boards being separately disposed in association with the plates; and a connecting circuit board connected to the first and second circuit boards and the plasma display panel, wherein:

the plates are disposed respectively in parallel to two orthogonal edges of the conductor, the orthogonal edges intersecting each other at a right angle, the first electric conductive plate is fixed via a first insulation fixing member to the conductor and is electrically connected to and is fixed onto the first circuit board by a second fixing member, and the second electric conductive plate is fixed via a third insulation fixing member to the conductor and is electrically connected to and is fixed onto the second circuit board by a fourth fixing member.

20. A plasma display apparatus, comprising:

a plasma display panel on which electrodes are formed;

an electric conductive conductor for fixing the plasma display panel;

two electric conductive plates including first and second electric conductive plates disposed on a surface of the conductor opposing a surface on which the plasma display panel is disposed, the electric conductive plates being electrically connected to an end portion of the conductor;

two circuit boards including a first circuit board and a second circuit board electrically connected respectively to the electric conductive plates, the first and second circuit boards being separately disposed in association with the plates; and a connecting circuit board connected to the first and second circuit boards and the plasma display panel, wherein:

the plates are disposed respectively in parallel to two orthogonal edges of the conductor, the orthogonal edges intersecting each other at a right angle, the first electric conductive plate is fixed onto a long-edge side of the conductor, the second electric conductive plate is fixed onto a short-edge side of the conductor, the first and second electric conductive plates overlap with each other to include overlapped portions respectively thereof, and the overlapped portions being disposed with a space or an insulation substance therebetween.

21. A plasma display apparatus according to claim 20, wherein the overlapped portions are different in distance relative to the conductor.

22. A plasma display apparatus, comprising:

a plasma display panel on which electrodes are formed;

an electric conductive conductor for fixing the plasma display panel;

two electric conductive plates including first and second electric conductive plates disposed on a surface of the conductor opposing a surface on which the plasma display panel is disposed, the electric conductive plates being electrically connected to an end portion of the conductor;

two circuit boards including a first circuit board and a second circuit board electrically connected respectively to the electric conductive plates, the first and second circuit boards being separately disposed in association with the plates; and a connecting circuit board connected to the first and second circuit boards and the plasma display panel, wherein:

the plates are disposed respectively in parallel to two orthogonal edges of the conductor, the orthogonal edges intersecting each other at a right angle, the first electric conductive plate is fixed onto a long-edge side of the conductor, the second electric conductive plate is fixed onto a short-edge side of the conductor, and distance between the first electric conductive plate and the conductor is different from distance between the second electric conductive plate and the conductor.

23. A plasma display apparatus, comprising:

a plasma display panel on which electrodes are formed;

an electric conductive conductor for fixing the plasma display panel;

two electric conductive plates including first and second electric conductive plates disposed on a surface of the conductor opposing a surface on which the plasma display panel is disposed, the electric conductive plates being electrically connected to an end portion of the conductor;

two circuit boards including a first circuit board and a second circuit board electrically connected respectively to the electric conductive plates, the first and second circuit boards being separately disposed in association with the plates; and a connecting circuit board connected to the first and second circuit boards and the plasma display panel, wherein:

the plates are disposed respectively in parallel to two orthogonal edges of the conductor, the orthogonal edges intersecting each other at a right angle, the first electric conductive plate is fixed onto a long-edge side of the conductor, the second electric conductive plate is fixed onto a short-edge side of the conductor, a distance between the first electric conductive plate and the conductor is substantially equal to distance between the second electric conductive plate and the conductor, and the first and second electric conductive plates are electrically isolated from each other.

* * * * *